US010648201B2

(12) United States Patent
Cumbo et al.

(10) Patent No.: US 10,648,201 B2
(45) Date of Patent: May 12, 2020

(54) INERTIAL LOCK DEVICE FOR RELEASE CABLE ASSEMBLY

(71) Applicant: Magna Closures S.p.A., Guasticce (Leghorn) (IT)

(72) Inventors: Francesco Cumbo, Pisa (IT); Luca Bigazzi, Ponsacco (IT)

(73) Assignee: MAGNA CLOSURES S.P.A., Guasticce (Leghorn) (IT)

( * ) Notice: Subject to any disclaimer, the term of this patent is extended or adjusted under 35 U.S.C. 154(b) by 647 days.

(21) Appl. No.: 15/294,956

(22) Filed: Oct. 17, 2016

(65) Prior Publication Data

US 2017/0114575 A1 Apr. 27, 2017

Related U.S. Application Data

(60) Provisional application No. 62/246,239, filed on Oct. 26, 2015.

(51) Int. Cl.
*E05B 77/06* (2014.01)
*E05B 77/54* (2014.01)
*E05B 79/20* (2014.01)

(52) U.S. Cl.
CPC ..... *E05B 77/06* (2013.01); *E05B 77/54* (2013.01); *E05B 79/20* (2013.01)

(58) Field of Classification Search
CPC ..... E05B 77/06; E05B 79/20; E05B 81/14; E05B 77/02; E05B 77/04; E05B 77/12; E05B 53/005; E05B 81/28; E05B 81/34; E05B 81/46; Y10T 292/0908; Y10S 292/22
See application file for complete search history.

(56) References Cited

U.S. PATENT DOCUMENTS 5,813,726 A 9/1998 Husted
7,201,405 B2 * 4/2007 Le ..... E05B 77/06 292/93

(Continued)

FOREIGN PATENT DOCUMENTS

CN 1495330 A 5/2004
CN 101684696 A 3/2010

(Continued)

*Primary Examiner* — Mark A Williams
(74) *Attorney, Agent, or Firm* — Dickinson Wright PLLC

(57) ABSTRACT

A release cable assembly having a release cable and an inertial locking device is provided. The release cable includes a cable wire configured to operably interconnect a release handle to a moveable latch release component of a latch assembly. The inertial locking device is configured to normally permit translational movement of the cable wire, via actuation of the release handle, to move the latch release component from a latched position to an unlatched position when the inertial locking device is exposed to an acceleration that is less than a predetermined acceleration threshold. When the inertial locking device is exposed to an acceleration exceeding the predetermined acceleration threshold, the inertial locking device prevents translational movement of the release cable, thereby preventing unintentional movement of the latch release component from the latched position to the unlatched position.

22 Claims, 20 Drawing Sheets

(56) References Cited

U.S. PATENT DOCUMENTS

| | | | | |
|---|---|---|---|---|
| 7,232,164 | B2 * | 6/2007 | Lee | E05B 77/06 292/336.3 |
| 7,635,151 | B2 * | 12/2009 | Rodawold, Jr. | E05B 77/06 292/336.3 |
| 8,322,077 | B2 * | 12/2012 | Papanikolaou | E05B 77/06 292/336.3 |
| 2007/0120382 | A1 * | 5/2007 | Chevalier | E05B 77/06 292/336.3 |
| 2010/0301618 | A1 | 12/2010 | Costigan et al. | |
| 2014/0312630 | A1 * | 10/2014 | Bendel | E05B 77/06 292/195 |
| 2015/0218854 | A1 * | 8/2015 | Muller | E05B 77/06 292/336.3 |
| 2015/0337566 | A1 * | 11/2015 | Wittelsbuerger | E05B 77/02 292/194 |
| 2015/0337567 | A1 | 11/2015 | Puscas et al. | |
| 2016/0024819 | A1 * | 1/2016 | Rosales | E05B 77/06 292/92 |
| 2016/0097223 | A1 * | 4/2016 | Rosales | E05B 77/12 292/92 |
| 2016/0201360 | A1 * | 7/2016 | Rosales | E05B 79/20 292/225 |
| 2016/0290015 | A1 * | 10/2016 | Puscas | E05B 79/16 |
| 2017/0114575 | A1 * | 4/2017 | Cumbo | E05B 77/06 |

FOREIGN PATENT DOCUMENTS

| | | | |
|---|---|---|---|
| CN | 102317558 | A | 1/2012 |
| CN | 102656035 | A | 9/2012 |
| CN | 104120916 | A | 10/2014 |

* cited by examiner

FIG. 7
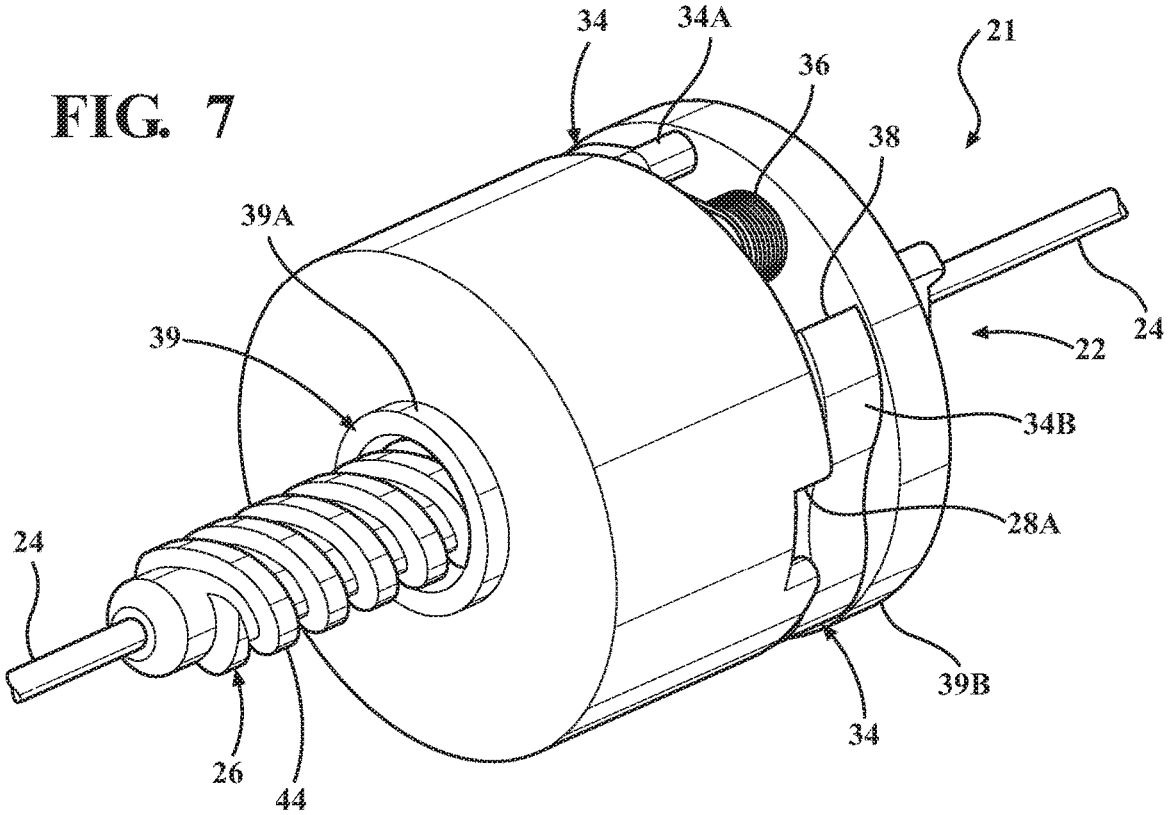
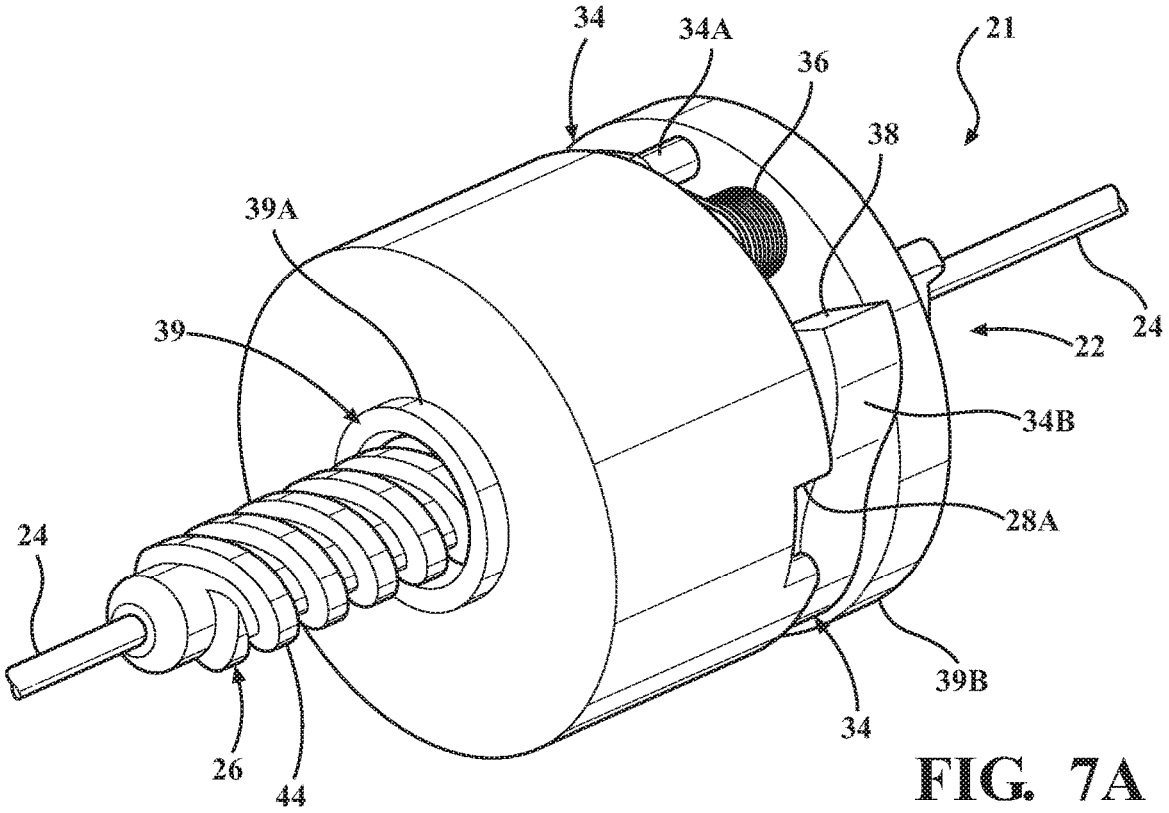
FIG. 7A

INERTIAL LOCK DEVICE FOR RELEASE CABLE ASSEMBLY

CROSS-REFERENCE TO RELATED APPLICATION

This application claims the benefit of U.S. Provisional Application Ser. No. 62/246,239, filed Oct. 26, 2015, which is incorporated herein by reference in its entirety.

FIELD OF THE INVENTION

The present disclosure relates generally to latch operation of vehicle closure panels under the influence of a release cable, and more particularly to a release cable assembly having an inertial lock device and a release cable which is adapted to operably interconnect a door handle to a latch assembly in a motor vehicle closure system.

BACKGROUND OF THE INVENTION

This section provides background information related to the present disclosure that is not necessarily prior art.

It is known to configure vehicle door latches to inhibit opening of the door in the event of a vehicle crash, so as to inhibit or otherwise restrict vehicle occupants from being ejected from the vehicle. Some safety systems for latches that provide such a feature do so by way of inertial members that swing into a selected position, as a result of predefined accelerations that occur during the crash event itself, to inhibit undesirable opening of the latch during the crash event. Other safety systems for latches can employ a control system that attempts to determine when a crash event is imminent and then attempts to drive a latch operation inhibiting member into position to restrict operation of the latch.

In terms of inertial members, these safety systems provide for members to inhibit operation and subsequent opening of the latch by moving the inertial member and one or more latch components towards one another during a crash event, due to inertial differences that exist between the latch components and the inertial member during the crash event. The timing of relative movement between the inertial member and the latch component(s) is configured, based at least in part, on inertial member mass and component center of gravity, latch component(s) mass, and/or anticipated acceleration magnitude and direction imposed on the inertial member and the latch component(s) during the crash event.

During a vehicle crash or other emergency situation, vehicle doors have to be kept closed independently of handle activations or other user or external interventions (e.g. deformation of handles and/or other latch release components that cause the latch to prematurely unlatch during the crash event). Thus, control of undesired door opening during crash events is a very important matter in latching and opening system development because of homologation and safety implications. Current state of the art systems configured to accommodate for inertia effects experienced by latches, handles and release cables during crash events require a specific development of the handle or of the latch. Accordingly, the integration of these inertial systems is not easy and may not allow the necessary modularity. The integration of current inertial systems is also very invasive and the latch and the handle are not easily optimized, thus contributing to inefficient design and/or extra cost.

SUMMARY OF THE INVENTION

This section provides a general summary and is not intended to be an exhaustive and comprehensive listing of all possible aspects, objective and features associated with the present disclosure.

It is an object of the present disclosure to provide a vehicle closure system having an inertia-activated locking arrangement configured to obviate or mitigate at least some of the shortcomings associated with the above-presented state of the art safety systems.

In accordance with this objective, the present disclosure is directed to providing a release cable assembly having a release cable and an inertial locking device. The release cable includes a cable wire configured to operably interconnect a release handle to a moveable latch release component of a latch assembly. The inertial locking device is configured to normally permit translational movement of the cable wire, via actuation of the release handle, to move the latch release component from a latched position to an unlatched position when the inertial locking device is exposed to an acceleration that is less than a predetermined acceleration threshold. When the inertial locking device is exposed to an acceleration exceeding the predetermined acceleration threshold, the inertial locking device functions to prevent translational movement of the release cable, thereby preventing unintentional movement of the latch release component from the latched position to the unlatched position.

In accordance with another aspect of the disclosure, a release cable assembly is provided. The release cable assembly includes a drive member extending along an axis between opposite ends; a cable wire operably connecting a latch assembly of a vehicle panel to a release handle, the cable wire being attached to the drive member to translate the drive member in response to movement of the cable wire along said axis; at least one inertial mass configured for movement in response to movement of the cable wire and the drive member along the axis; at least one spring member imparting a bias to promote the movement of the inertial mass in response to movement of the drive member along the axis below an acceleration threshold, wherein inertia of the inertial mass overcomes the bias of the at least one spring member during movement of the drive member along the axis above the acceleration threshold to inhibit movement of the cable wire along the axis, thereby inhibiting movement of a latch release component of the latch assembly from a latched position to an unlatched position.

In accordance with another aspect of the disclosure, the release cable assembly can further include a driven member configured for rotational movement in direct response to linear movement of the drive member along the axis.

In accordance with another aspect of the disclosure, the release cable assembly can further include at least one clutch lever pivotally coupled to the driven member. The at least one spring member being configured to bias an abutment surface of the at least one clutch lever radially inwardly to promote co-rotation of the inertial mass with the driven member during movement of the drive member along the axis below the acceleration threshold. The abutment surface of the at least one clutch lever being biased radially outwardly against the bias of the at least one spring member by inertia of the inertial mass to inhibit movement of the cable wire along the axis during movement of the drive member along the axis above the acceleration threshold.

In accordance with another aspect of the disclosure, the release cable assembly can further include a housing having at least one blocking abutment, wherein the abutment surface is biased out of engagement from the least one blocking abutment by the at least one spring member during movement of the drive member below the acceleration threshold, and wherein the abutment surface is biased radially outwardly for engagement with the at least one blocking abutment during movement of the drive member above the acceleration threshold.

In accordance with another aspect of the disclosure, the housing can be provided with a plurality of the blocking abutments spaced circumferentially from one another to minimize the amount of travel of the cable wire when the acceleration of the drive member is above the acceleration threshold.

In accordance with another aspect of the disclosure, the drive member can have an external helical thread and the driven member can have a through bore with an internal helical thread, with the external and internal helical threads being threadedly coupled with one another to covert translational movement of the drive member into rotational movement of the driven member.

In accordance with another aspect of the disclosure, the driven member can have a tubular segment and a disk segment extending radially outwardly from the tubular segment, with the at least one clutch lever being pivotally coupled to the disk segment.

In accordance with another aspect of the disclosure, the at least one spring member can be carried by the disk segment, with the at least one spring member having a first end segment engaging the tubular segment and an opposite second end segment engaging the at least one clutch lever to bias the clutch member out of engagement with the blocking abutments during acceleration of the drive member below the acceleration threshold.

In accordance with another aspect of the disclosure, the inertial mass can be provided with an elongated cam slot, with the at least one clutch lever having a cam pin disposed in the cam slot and being configured for sliding movement in the cam slot during movement of the drive member along the axis above the acceleration threshold to bring the clutch lever into engagement with the blocking abutment to inhibit translation of the cable wire.

In accordance with another aspect of the disclosure, the driven member can include a first driven member and a second driven member configured in meshed engagement with one another, with the first driven member being configured in meshed engagement with the drive member and the second driven member being operably coupled to the at least one inertial mass by the at least one spring member.

In accordance with another aspect of the disclosure, the first driven member can be provided having a blocking abutment fixed thereto and the at least one inertial mass can be provided having an abutment surface fixed thereto, wherein the abutment surface is configured to move out of radial alignment from the blocking abutment during movement of the drive member below the acceleration threshold, and wherein the abutment surface is configured to remain in radial alignment with and confront the blocking abutment during movement of the drive member above the acceleration threshold.

In accordance with another aspect of the disclosure, the bias imparted by the at least one spring member causes the at least one inertial mass to co-rotate with the second driven member during movement of the drive member below the acceleration threshold, and wherein the bias of the at least one spring member is overcome by inertia of the at least one inertial mass during movement of the drive member above the acceleration threshold, thereby causing the at least one inertial mass to resist rotating with the second driven member.

In accordance with another aspect of the disclosure, the at least one inertial mass can include first and second inertial masses configured for pivotal rotation about a pair of pivot members during movement of the drive member along the axis above the acceleration threshold.

In accordance with another aspect of the disclosure, the first and second inertial masses can be pivotably mounted on the drive member for non-rotating, translating movement with the drive member during movement of the drive member along the axis below the acceleration threshold.

In accordance with another aspect of the disclosure, the first and second inertial masses can be configured to be biased against pivotal rotation about the pair of pivot members by a bias imparted by the at least one spring member during movement of the drive member along the axis below the acceleration threshold.

In accordance with another aspect of the disclosure, the bias imparted by the at least one spring member on the first and second inertial masses can be provided to be overcome by inertia of the first and second inertial masses during movement of the drive member along the axis above the acceleration threshold, thereby causing the first and second inertial masses to pivot about the pair of pivot members to bring abutment surfaces extending from the first and second inertial masses into engagement with blocking abutments and to inhibit movement of the cable wire along the axis.

Further areas of applicability will become apparent from the detailed description provided herein. The description and specific examples provided in this summary are intended for purposes of illustration only and are not intended to limit the scope of the present disclosure.

BRIEF DESCRIPTION OF THE DRAWINGS

The foregoing and other aspects will now be described by way of example only with reference to the attached drawings, in which:

FIG. 7 is a perspective view of the release cable assembly of FIG. 4 with the cover section and housing section removed therefrom showing various components of the inertial locking device while in an unlocked position;

FIG. 7A is a view similar to FIG. 7 showing various components of the inertial locking device while in a locked position;

Corresponding reference numerals indicate corresponding components throughout the several views of the drawings, unless otherwise indicated.

DETAILED DESCRIPTION OF PRESENTLY PREFERRED EMBODIMENTS

Example embodiments of inertia lockable release cable assemblies of the type configured for use with motor vehicle closure systems are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies, as would be evident to one skilled in the art upon viewing the disclosure herein, are not described in detail.

Figure 1:
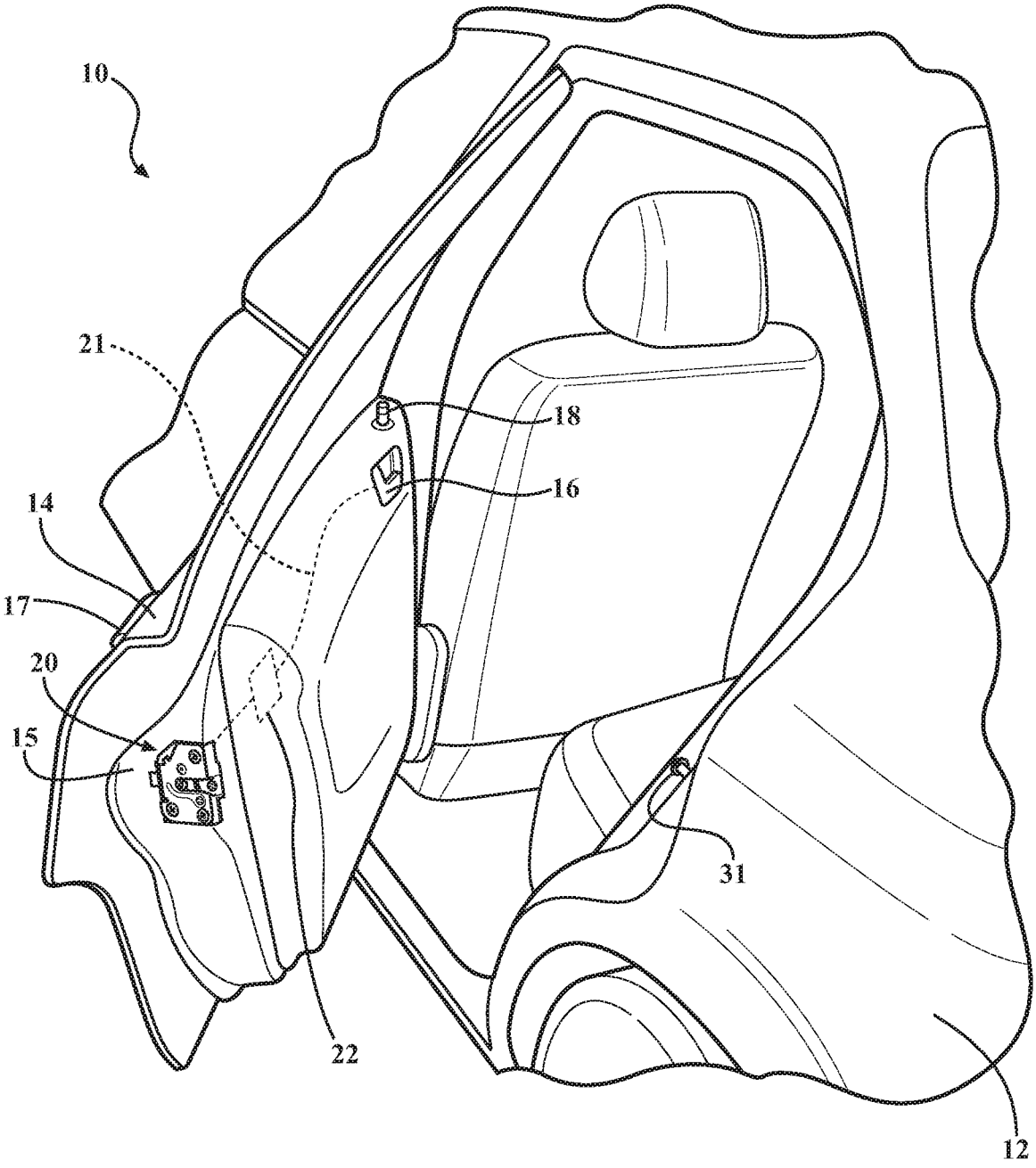
FIG. 1 is a partial perspective view of a motor vehicle equipped with a pivotal passenger-entry door having a door handle operably interconnected to a latch assembly via a release cable assembly constructed in accordance with and embodying the teachings of the present disclosure.

FIG. 1 is a perspective view of a vehicle 10 that includes a vehicle body 12 and at least one vehicle closure panel, shown as a vehicle door 14, by way of example and without limitation. The vehicle door 14 includes an edge face 15, inside and outside door handles 16, 17, a lock knob 18, with a hinge 19 pivotally fixing the door 14 to the vehicle body 12. A latch assembly 20 is positioned on the edge face 15 and which includes a latch mechanism having a pivotal latch (i.e. ratchet) member that is releasably engageable with a striker 31 mounted on the vehicle body 12 to releasably hold the vehicle door 14 in a closed position. The inside and outside door handles 16, 17 are operably connected to the latch assembly 20 for opening the latch assembly 20 (i.e. for releasing striker 31 from latched engagement with the latch member of the latch mechanism) to open the vehicle door 14. The lock knob 18 (optional) is shown and provides a visual indication of the lock state of the latch assembly 20 and may be operable to change the lock state between an unlocked state and a locked state. At least one of the handles 16, 17 is connected to the latch assembly 20 via a release cable assembly 21, constructed in accordance with the disclosure, for facilitating actuation of latch assembly 20 via intended (selective) operation of the handles 16, 17. Specifically, the release cable assembly 21 connects one of handles 16, 17 to the moveable latch member release component of the latch mechanism. As is detailed hereafter, the release cable assembly 21 of the present disclosure is configured to include an inertial locking device 22 integrated therein to prevent unintended, unwanted unlatching of the latch assembly 20, such as during a event causing high acceleration or deceleration of the release cable assembly 21, such as during a crash event, by way of example and without limitation.

Figure 2:
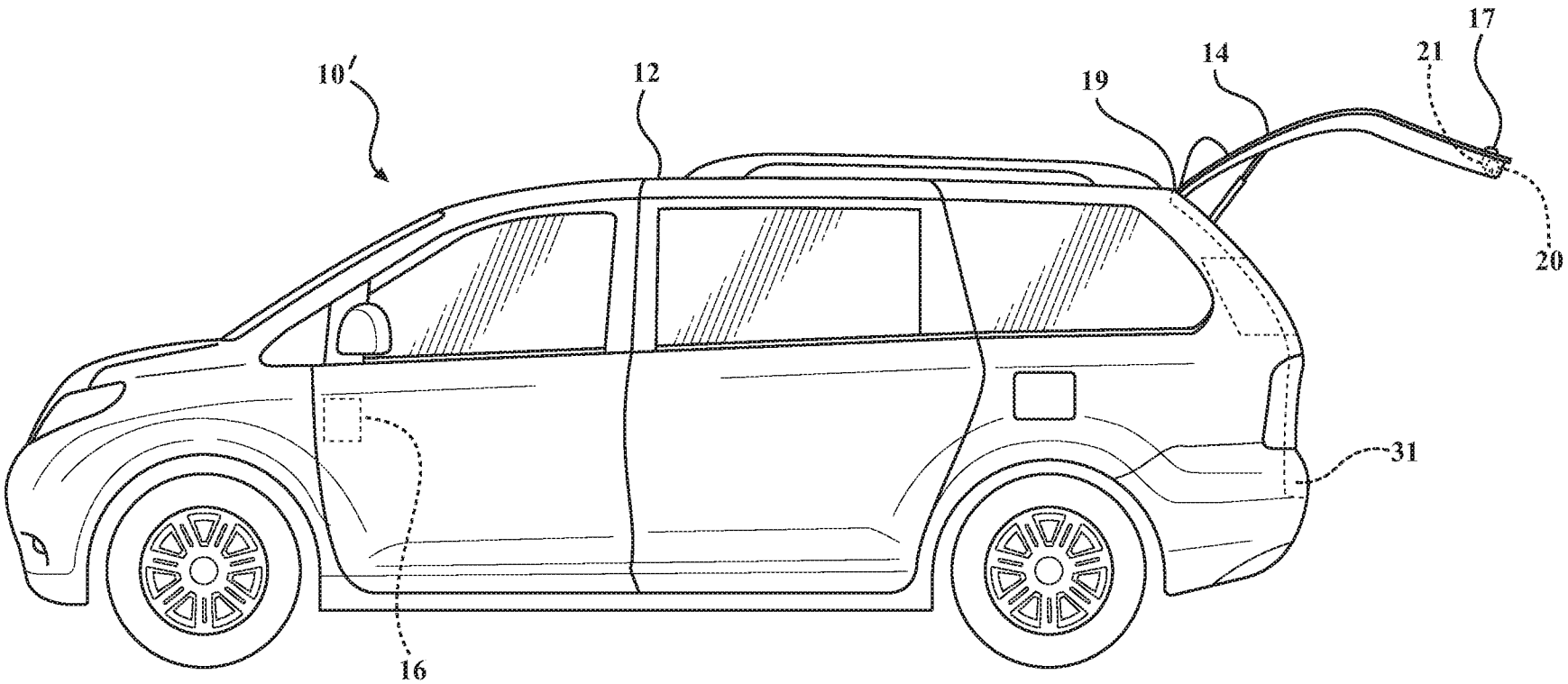
FIG. 2 is a side view of another motor vehicle equipped with a pivotal cargo-entry door having a door handle operably interconnected to a latch assembly via a release cable assembly also constructed in accordance with and embodying the teachings of the present disclosure.

Referring now to FIG. 2, an alternative embodiment of a vehicle 10' is shown to have a latch assembly 20 mounted on a closure panel, shown as a hatch 14, by way of example and without limitation. Similarly to that shown in FIG. 1, the handles 16, 17 can be connected to the latch assembly 20 via a release cable assembly 21, constructed in accordance with the disclosure, for facilitating actuation of latch assembly 20 via selective, intended actuation of handles 16, 17. The interior handle 16 is shown as a hatch release device located inside vehicle 10' while the exterior handle 17 is shown mounted to an exterior surface of the hatch 14.

In general, the closure panel 14 (e.g. occupant ingress or egress controlling panels such as but not limited to vehicle doors and lift gates/hatches) is connected to vehicle body 12 via one or more hinges 19 (e.g. for retaining closure panel 14. It is to be recognized that the hinge(s) 19 can be configured as a biased hinge that is operable to bias closure panel 14 toward the open position and/or toward the closed position, as desired. The vehicle body 12 can include the mating latch component 31 (e.g. striker) mounted thereon for coupling with a respective latching component (i.e. the ratchet) of latch assembly 20 mounted on closure panel 14. Alternatively, latch assembly 20 can be mounted on vehicle body 12 and the mating latch component 31 can be mounted on the closure panel 14 (not shown, but will be readily understood by one skilled in the art).

For vehicles 10, 10', closure panel 14 can be referred to as a partition or door, typically hinged, but sometimes attached by other mechanisms such as tracks, in front of an opening which is used for entering and exiting vehicle 10, 10' interior by people and/or cargo. It is also recognized that closure panel 14, as discussed herein with respect to operation of release cable assembly 21, can be used as an access panel for vehicle systems such as engine compartments and traditional trunk compartments of automotive type vehicles 10, 10'. Closure panel 14 can be opened to provide access to vehicle 10, 10' interior, or closed to secure or otherwise restrict access to and from vehicle 10, 10' interior by vehicle occupant(s). It is also recognized that there can be one or more intermediate open positions (e.g. unlatched position) of closure panel 14 between a fully open panel position (e.g. unlatched position) and fully closed panel position (e.g. latched position), as provided at least in part by the panel hinges.

Movement of the closure panel 14 (e.g. between the open and closed positions) can be electronically and/or manually operated, where power assisted closure panels 14 can be found on minivans, high-end cars, or sport utility vehicles (SUVs) and the like. As such, it is recognized that movement of the closure panel 14 can be manual or power assisted during intended operation of closure panel 14, for example, between fully closed (e.g. locked or latched) and fully open positions (e.g. unlocked or unlatched); between locked/latched and partially open positions (e.g. unlocked or unlatched); and/or between partially open (e.g. unlocked or unlatched) and fully open positions (e.g. unlocked or unlatched). It is recognized that the partially open position of the closure panel 14 can also include a secondary lock position.

In terms of vehicles 10, 10', closure panel 14 may be a driver/passenger door, a lift gate, or it may be some other kind of closure panel 14, such as an upward-swinging vehicle door (i.e. what is sometimes referred to as a gull-wing door) or a conventional type of door that is hinged at a front-facing or back-facing edge of the door, and so allows the door to swing (or slide) away from (or toward) the opening in body 12 of vehicle 10, 10'. Also contemplated are sliding door embodiments of closure panel 14 and canopy door embodiments of closure panel 14, such that sliding doors can be a type of door that open by sliding horizontally or vertically, whereby the door is either mounted on, or suspended from a track that provides for a larger opening. Canopy doors are a type of door that sit on top of the vehicle and lift up in some way, to provide access for vehicle passengers via the opening (e.g. car canopy, aircraft canopy, etc.). Canopy doors can be connected (e.g. hinged at a defined pivot axis and/or connected for travel along a track) to the body 12 of the vehicle 10, 10' at the front, side or back of the door, as the application permits. It is recognized that body 12 can be represented as a body panel of vehicle 10, 10', a frame of vehicle 10, 10', and/or a combination frame and body panel assembly, as desired.

Figure 3:
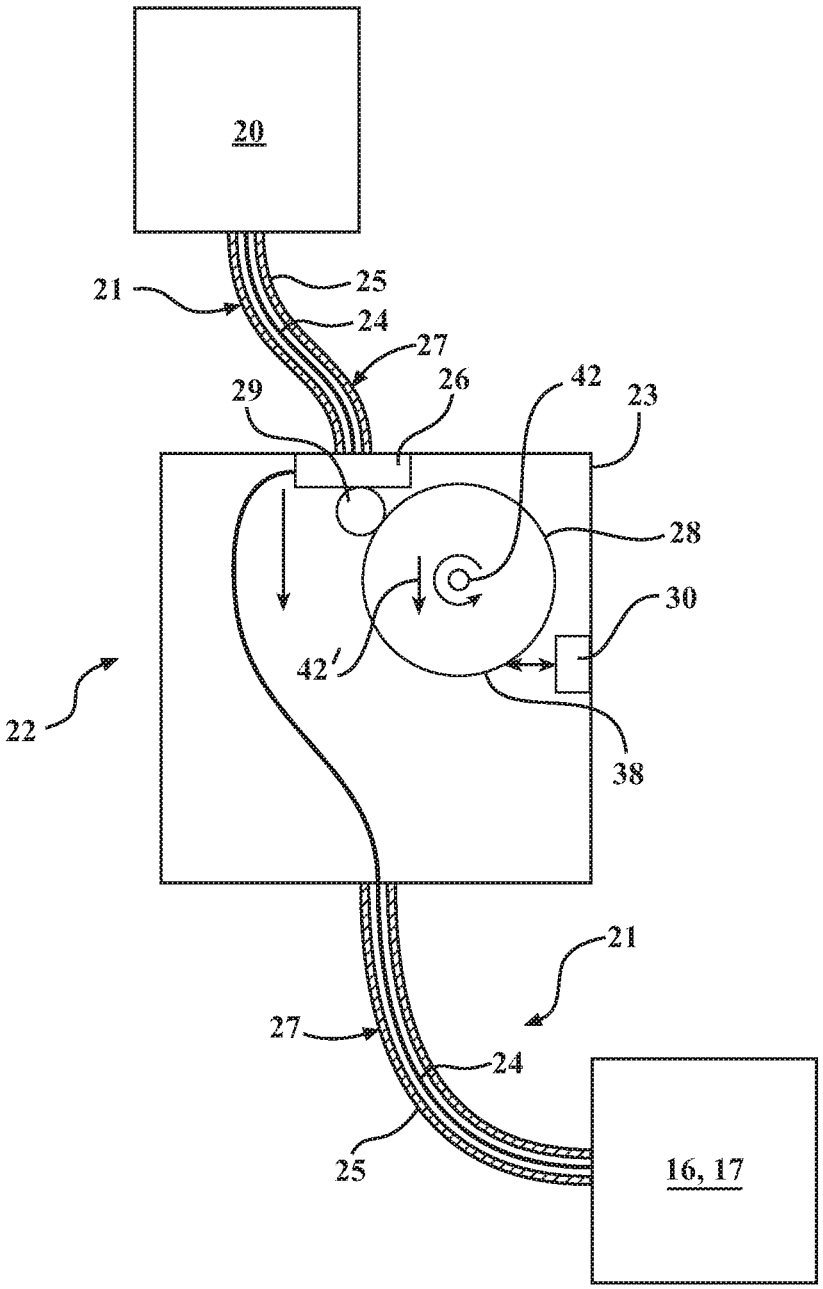
FIG. 3 is a schematic illustration of a general configuration associated with each embodiment of the release cable assembly constructed in accordance with and embodying the teachings of the present disclosure.

Referring now to FIG. 3, a generic, schematic embodiment of a latch assembly 20 is shown coupled to at least one handle 16, 17 via a release cable assembly 21 constructed in accordance with the disclosure. Release cable assembly 21 has a bowden-type release cable 27 operably attached to an inertia locking device 22, constructed in accordance with the disclosure, for operably restricting translation of a cable wire 24 within a sleeve 25 of the release cable 27 in the event of a sudden acceleration above an acceleration threshold, wherein the sudden acceleration is sufficient to actuate the inertia locking device 22, such as in a crash or other sudden stop scenario of vehicle 10. Inertia locking device 22 includes a housing 23 and a drive member, also referred to as translation member or translation component 26, operably connected to the cable wire 24 such that linear movement of the cable wire 24 corresponds to direct and conjoint or coincident, linear movement of the translation component 26. Inertia locking device 22 further includes an inertial mass 28 that is mounted for pivotal, rotational and/or linear movement in the housing 23. In particular, the inertial mass 28 is operably coupled to the translation component 26 via a coupling mechanism 29 such that linear motion of the translation component 26 can be converted into pivotal, rotational or linear coincident movement of the inertial mass 28 about a pivotal, rotational axis 42 or along a linear axis 42' via the coupling mechanism 29 when the translation component 26 experiences a linear acceleration below a predetermined, specified acceleration threshold. However, when the translation component 26 experiences an acceleration above the predetermined, specified acceleration threshold, the coupling mechanism 29 is caused to rotate or otherwise translate relative to the inertial mass 28, whereupon blocking abutments 30 can be aligned for engagement with one or more abutment surfaces 38, as is further described below by example. In the event of sufficient acceleration of the coupling mechanism 29 relative to the inertial mass 28, the blocking abutments 30 are confronted and engaged by the abutment surfaces 38, thereby inhibiting further translational/linear travel of the translation component 26 and cable wire 24 within sleeve 25 of release cable 27, thereby preventing the latch assembly 20 from becoming unlatched.

In other words, for acceleration(s) of translation component 26 below the specified acceleration threshold, inertial mass 28 rotates or translates conjointly in a directly proportional (1:1 velocity/acceleration relation) or substantially proportional relationship with the coupling mechanism 29, such that no or substantially no (meaning very little, if any) relative rotation or translation takes place between the inertial mass 28 and the coupling mechanism 29. As such, the abutment surfaces 38 and the blocking abutments 30, as discussed further below, remain out of engagement from one another, and the translation component 26 and cable wire 24 fixed thereto are able to translate linearly, as intended, during selective actuation of the handles 16, 17 (i.e. typical actuation of handles 16, 17 by the vehicle occupant provides for actuation of latch assembly 20 and thus desired opening of closure panel 14—see FIGS. 1 and 2). On the contrary, for acceleration(s) of translation component 26 above the specified acceleration threshold, the coupling mechanism 29 is caused to rotate or translate relative to the inertial mass 28 to a degree by which circumferentially spaced blocking abutments 30 are confronted and engaged by the abutment surfaces 38, and therefore further translational/linear travel of cable wire 24 within sleeve 25 is inhibited (i.e. acceleration of cable wire 24 and translation component 26 due to sudden stops or crash events provides for inhibition of latch assembly 20 actuation via inertia locking device 22, and thus, the closure panel 14 is retained in a closed state during such sudden stops or crash events, as desired, thereby protecting the vehicle occupant against ejection from the vehicle, amongst other things).

Figure 4:
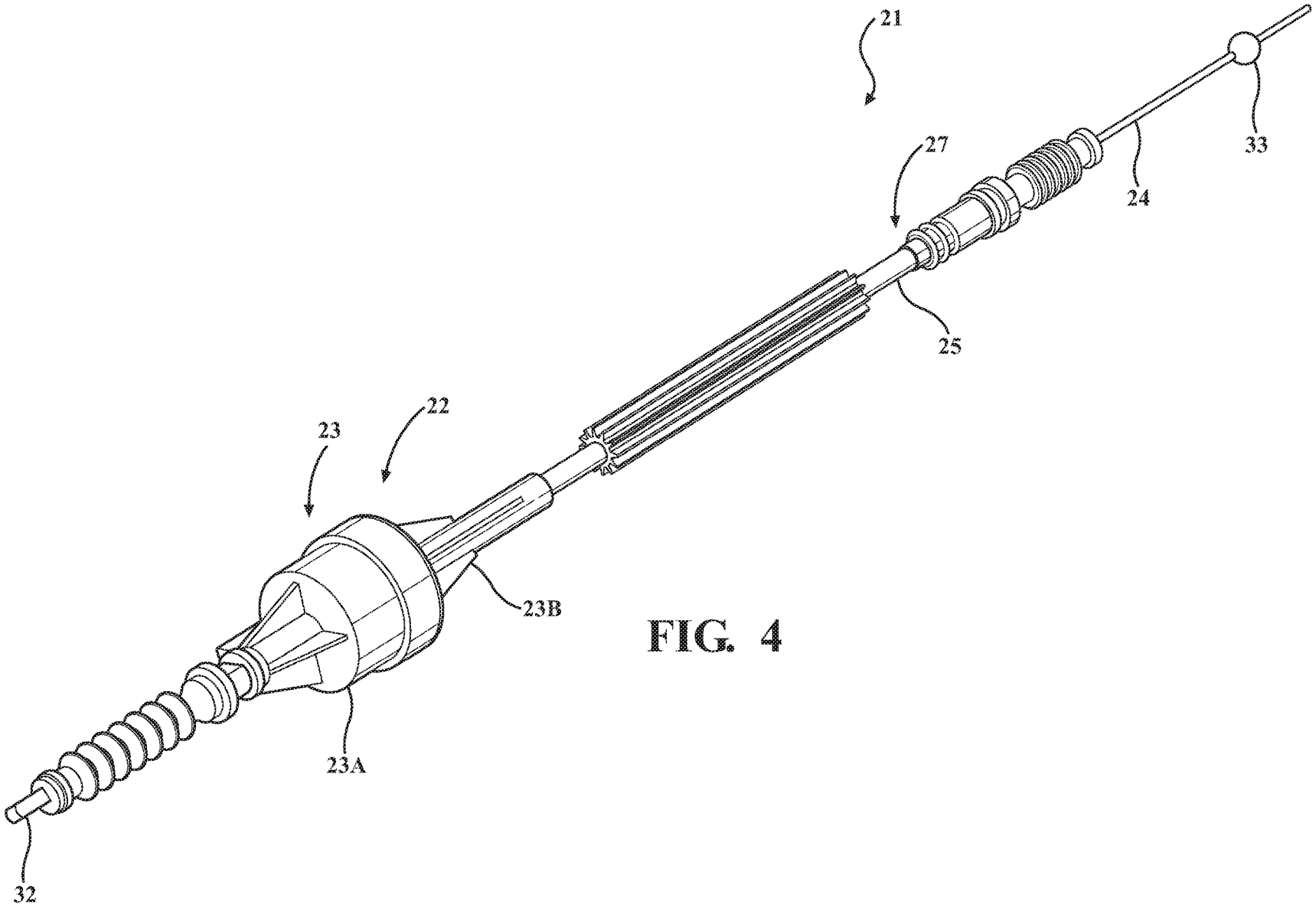
FIG. 4 is a perspective view of a release cable assembly constructed in accordance with a first non-limiting embodiment of the present disclosure.
Figure 5:
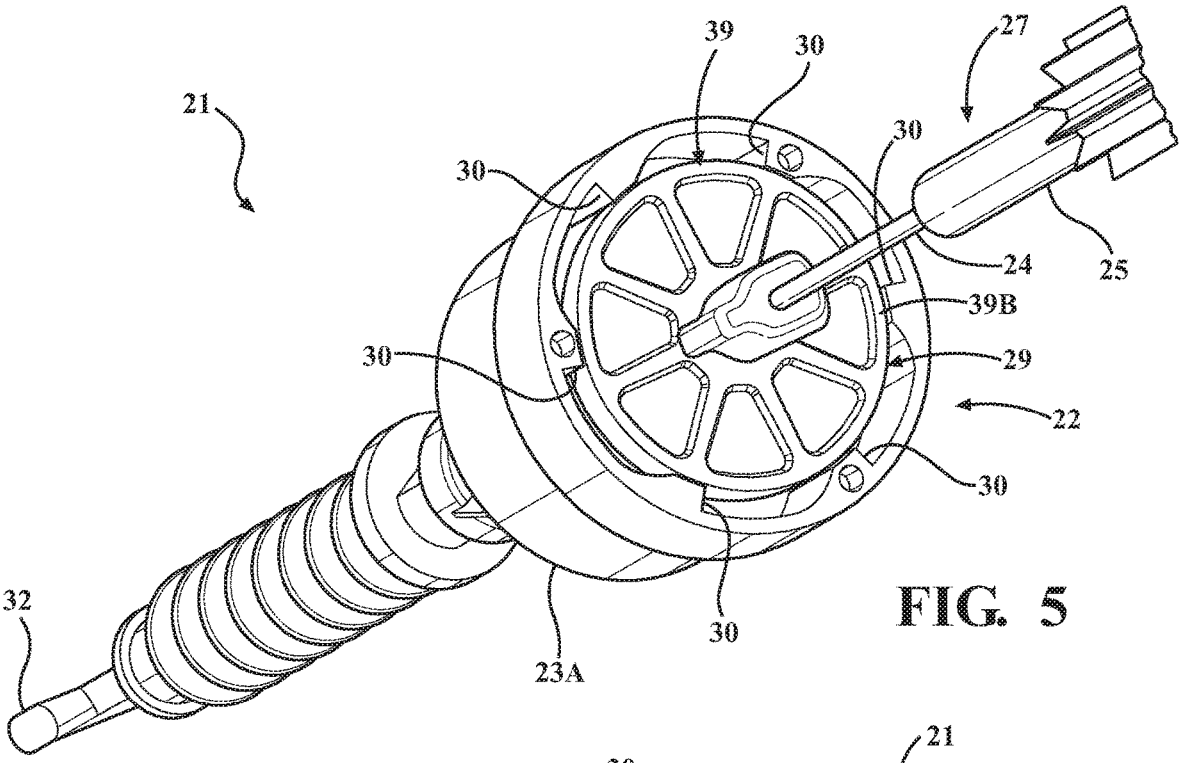
FIG. 5 is a perspective view of the release cable assembly of FIG. 4 with a cover section removed therefrom showing various components of an inertial locking device while in an unlocked position.
Figure 5A:
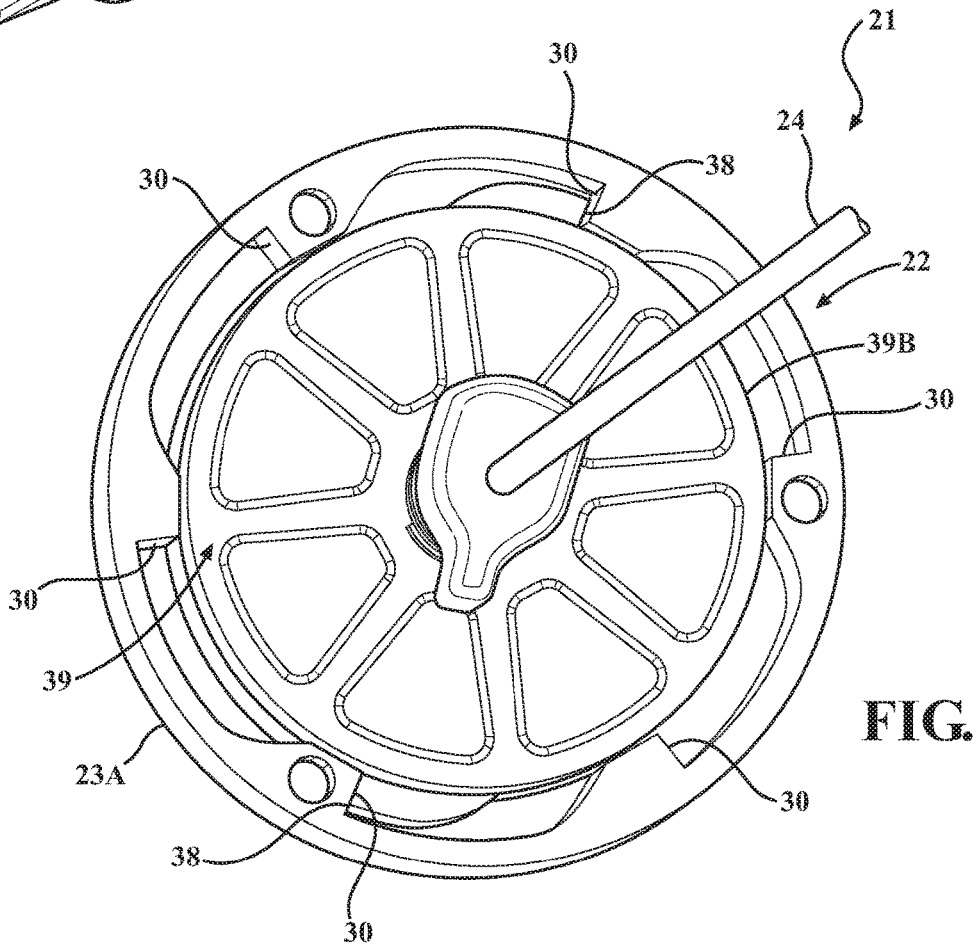
FIG. 5A is a view similar to FIG. 5 showing various components of the inertial locking device while in a locked position.
Figure 6:
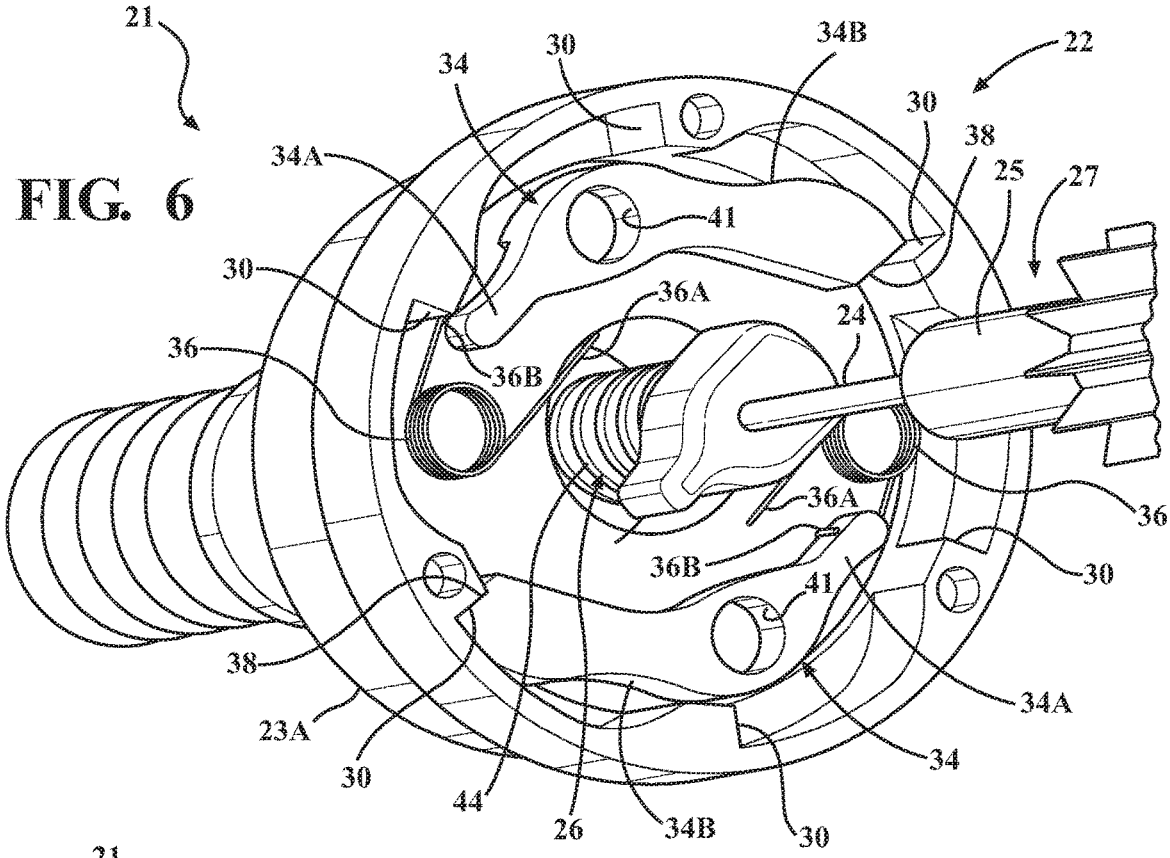
FIG. 6 is a view similar to FIG. 5 with a driven member removed to further illustrate various components of the inertial locking device and the release cable associated with the release cable assembly of FIG. 4 while in an unlocked position.
Figure 6A:
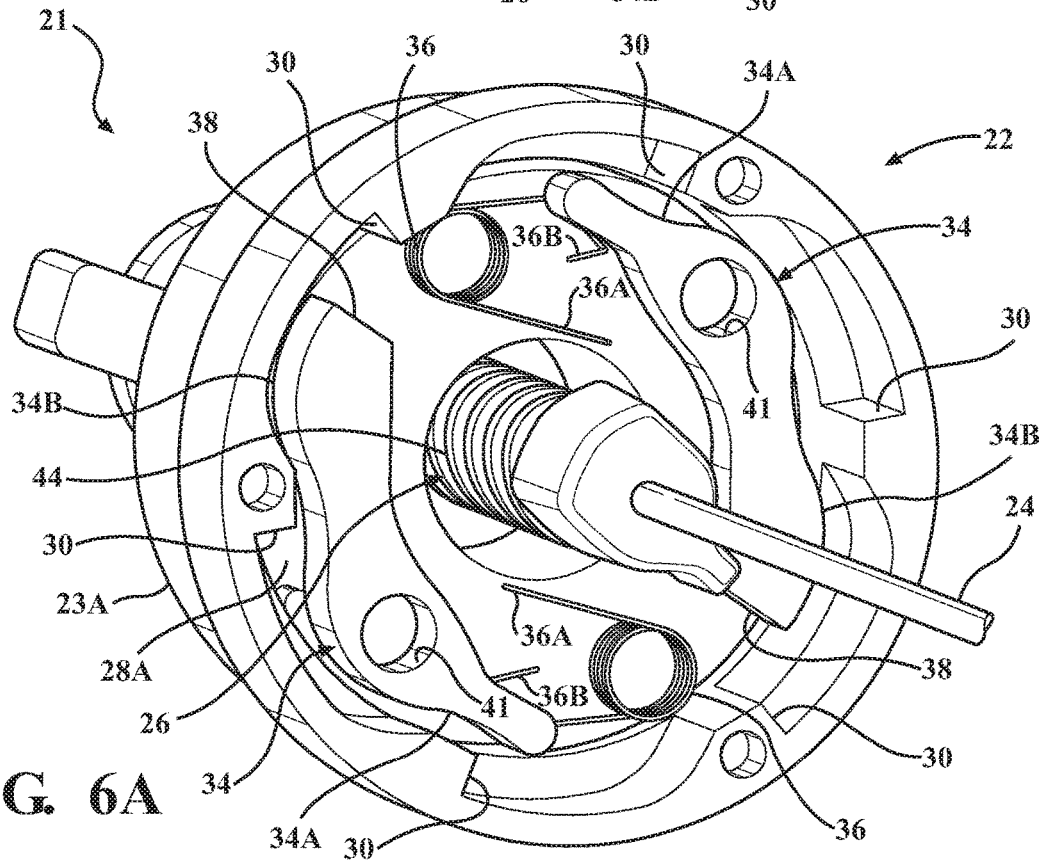
FIG. 6A is a view similar to FIG. 6 showing various components of the inertial locking device while moving into a locked position.
Figure 20A:
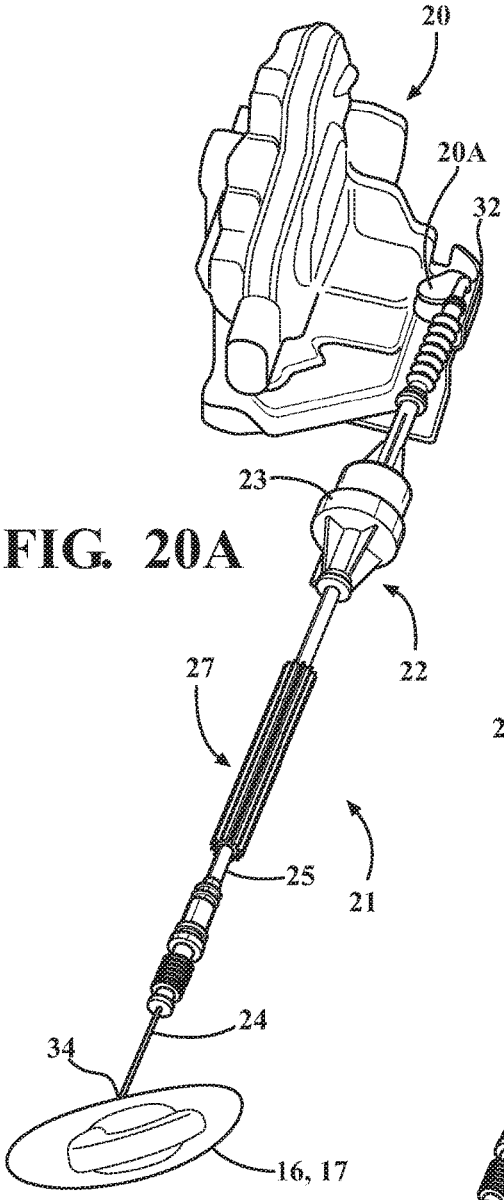
FIGS. 20A-20C respectively illustrate the release cable assemblies shown in FIGS. 4, 10 and 15 each operably interconnected between a moveable door handle and a moveable latch release component associated with a door latch assembly.

Referring now to FIGS. 4-6, a first non-limiting embodiment of release cable assembly 21 is shown configured such that inertia locking device 22 is mounted on, to, or arranged in operable conjunction with, cable wire 24 of release cable 27. Cable wire 24 of release cable 27 has a first end bushing 32 adapted for connecting to a moveable latch release component 20A (FIG. 20A) of the latch mechanism associated with latch assembly 20 and a second end bushing 33 adapted for connecting to handles 16, 17, such that movement of the handles 16, 17 is translated into actuation of the latch assembly 20 by translational/linear movement of the cable wire 24 within the sleeve 25.

Figure 8:
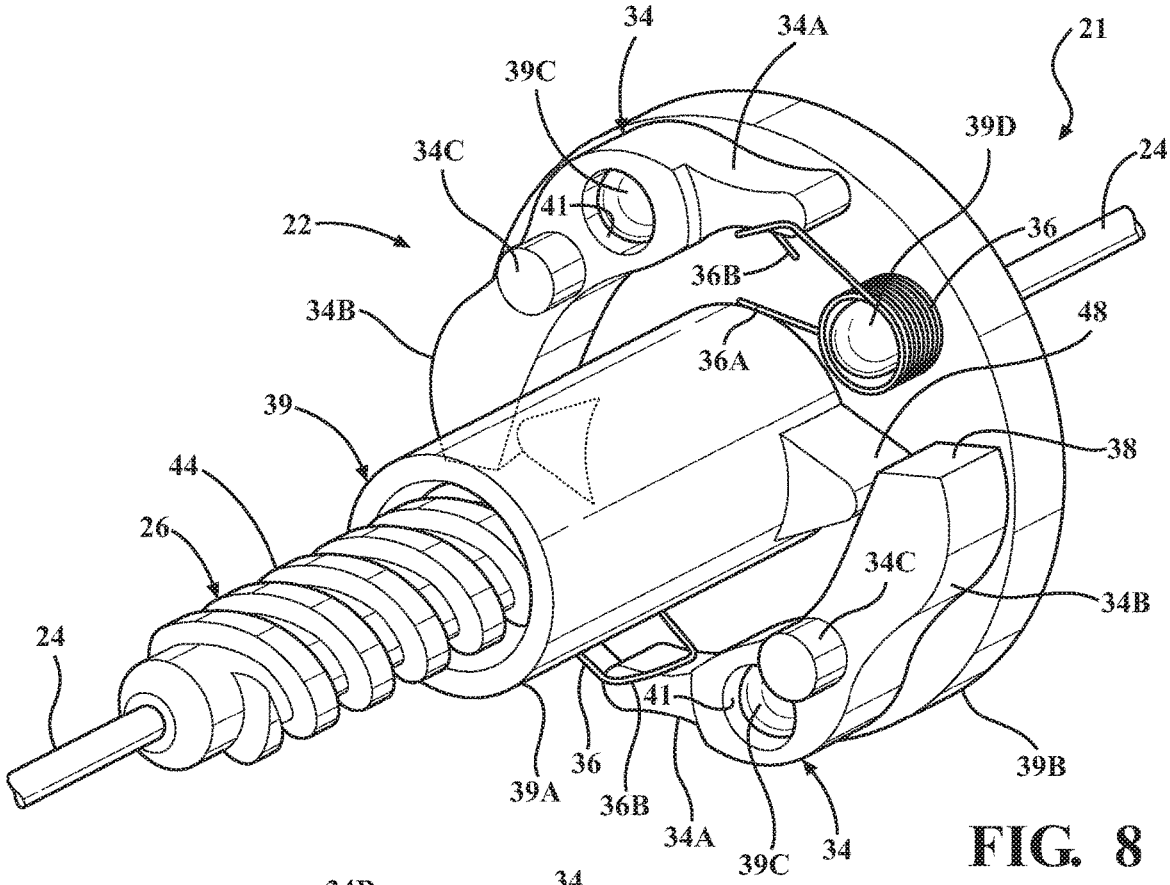
FIG. 8 is a view similar to FIG. 7 with an inertial mass removed therefrom showing various components of the inertial locking device while in an unlocked position.
Figure 8A:
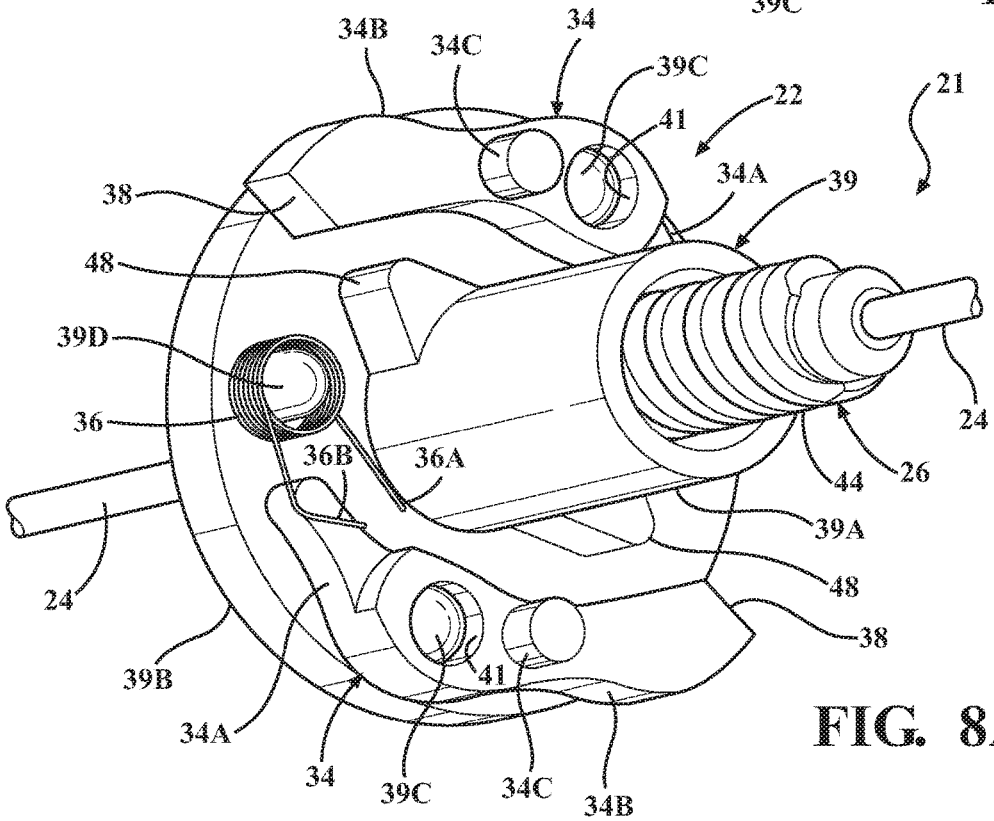
FIG. 8A is a view similar to FIG. 8 showing various components of the inertial locking device while in a locked position.
Figure 9:
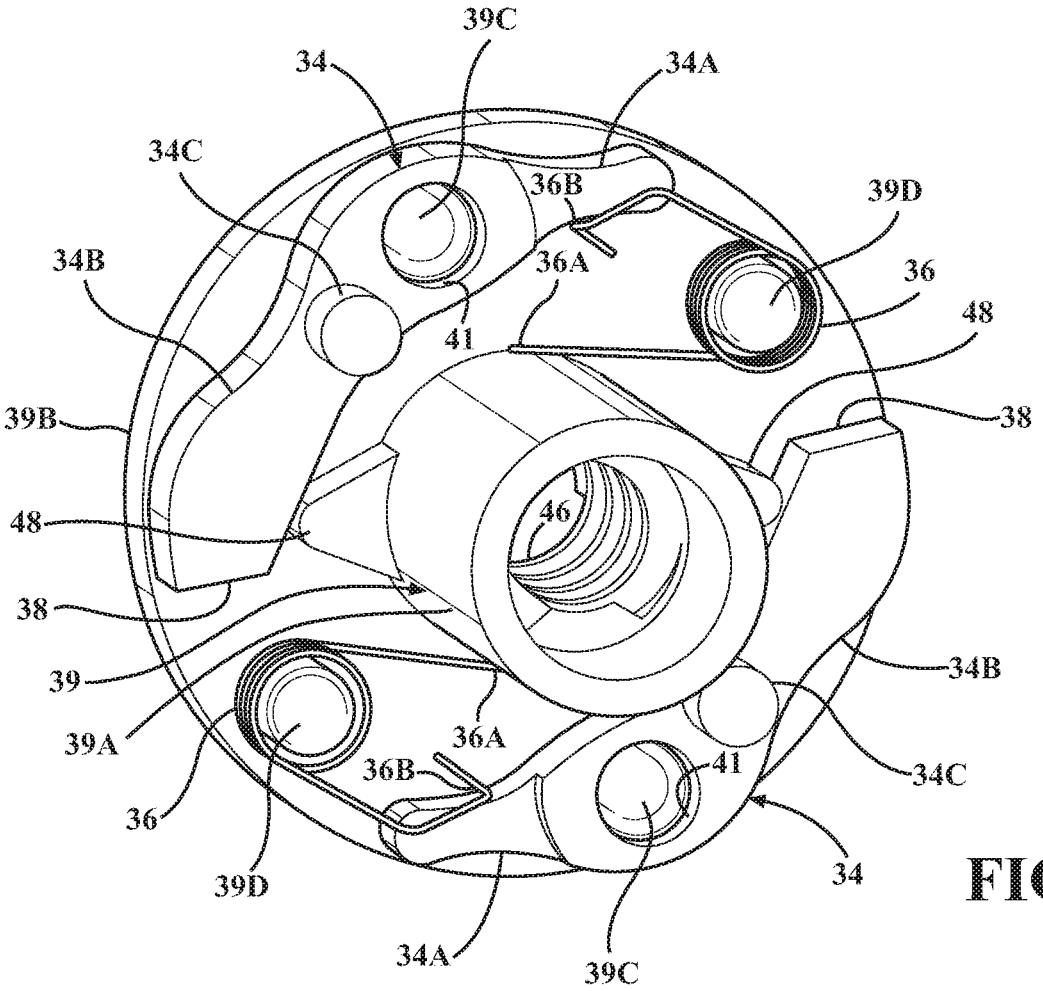
FIG. 9 is a view similar to FIG. 8 with a cable and drive member removed therefrom showing various components of the inertial locking device while in an unlocked position.

Inertia locking device 22 is shown, by way of example and without limitation, as having a two-piece outer shell, also referred to as housing 23, including a housing section 23A and a cover section 23B. Housing section 23A is shown, in this non-limiting example, as being configured for operable attachment to the latch assembly 20. Inertial locking device 22 also includes a drive member, also referred to as driver leadscrew or leadscrew 26 (e.g. referred to above as translation component 26) attached to the cable wire 24 (e.g. the leadscrew profile can be over molded about or otherwise fixed to the cable wire 24, such as in a crimping operation, by way of example and without limitation), such that translation of cable wire 24 causes coinciding, conjoint linear translation of the leadscrew 26. The leadscrew 26 is shown as having external helical threads 44 (male threads) threadably coupled with internal helical threads 46 (female threads) of a cylindrical tubular segment, also referred to as tube segment 39A, of a first driven member, also referred to as driven nut or nut 39, wherein the nut 39 defines a rotational axis 42. Nut 39 also includes a disk segment 39B from which tube segment 39A extends axially, wherein the disk segment 39B is shown as extending radially outwardly from the tube segment 39A. Disk segment 39B of nut 39, as best shown in FIGS. 8, 8A and 9, includes a pair of laterally extending, diametrically-opposed first protrusions, also referred to as pivot posts 39C and a pair of laterally extending, diametrically-opposed second protrusions, also referred to as spring posts 39D. The respective pairs of posts 39C, 39D are shown as being circumferentially staggered relative to one another by about 90 degrees, by way of example and without limitation.

A mass 28, also referred to as disk mass or inertial mass 28, includes a central aperture through which the tube segment 39A of nut 39 extends in a clearance fit. To facilitate coincident movement of the disk mass 28 with the nut 39 during a normal, intended unlatching actuation of the latch assembly 20, a coupling mechanism 29 is provided for operably interconnecting the disk mass 28 to nut 39. Specifically, a pair of second driven members, also referred to as lock members, lock levers or clutch levers 34, are mounted for direct rotational movement with the first driven member 39 and for pivotal movement on corresponding ones of the pivot posts 39C. Each clutch lever 34 includes a first leg segment 34A and a second leg segment 34B with a pocket or an opening 41 therebetween, in which the pivot posts 39C of the nut 39 are received, wherein the first and second segments 34A, 34B extend away from the openings 41 in opposite directions from one another. The second leg segments 34B each have a lock surface, also referred to as an abutment surface 38. To further facilitate operable movement of the disk mass 28 and the nut 39, whether coincident and co-rotating or substantially (nearly simultaneous and nearly same rotational speed, but slight deviation may occur) co-rotating movement with one another during normal actuation of the latch assembly 20 or for relative rotational movement with one another (disk mass can remain stationary or be rotating at a significantly reduced rotational speed relative to the nut 39, such as in the event of a crash, discussed further below, a pair of spring members, also referred to as clutch springs or springs 36, are disposed about the spring posts 39D on disk segment 39B of the nut 39. Accordingly, the springs 36 are operably attached to and carried by the disk segment 39B of the nut 39, with each spring 36 having a first spring end section 36A engaging the tubular segment 39A of nut 39 and a second spring end segment 36B engaging first leg segment 34A on a corresponding one of pivotal clutch levers 34. As such, the springs 36 impart a bias on the first leg segments 34A so as to normally bias the second leg segments 34B of clutch levers 34 radially inwardly, shown in FIGS. 8 and 9 as being biased into abutment with stop protrusions 48 extending radially outwardly from the tube segment 39A. With the clutch levers 34 being biased inwardly by the springs 36, the abutment surfaces 38 are released from engagement with stop surfaces, also referred to as blocking abutments or ratchet-type blocking abutments 30, wherein the second leg segments 34B are generally flush with an outer periphery of the disk segment 39B. The plurality of circumferentially spaced blocking abutments 30 are shown as being formed in the housing section 23A of the housing 23, by way of example and without limitation. This defines a first position, also referred to as "unlocked" position, for clutch levers 34, which allows for linear translation of the cable wire 24, such as during intended actuation of the latch assembly 20.

To facilitate operable engagement and conjoint, co-rotation of the nut 39 with the disk mass 28, such as during a normal unlatching operation of the latch assembly 20, each clutch lever 34 has a protrusion, also referred to as cam pin 34C (FIGS. 8, 8A and 9), extending laterally outwardly therefrom. Each cam pin 34C is operably attached or coupled with the disk mass 28 by being disposed in a separate, corresponding elongated cam slot or notch 28A (FIGS. 7 and 7A) formed in the disk mass 28, acting, at least in part, as the coupling mechanism 29. As such the disk mass 28 is coupled for conjoint, co-rotation with the nut 39 in response to translational movement of lead screw 26 with cable wire 24 during a normal actuating operation of the handle 16, 17; however, during a sudden acceleration of the cable wire 24, such as during a crash, the cam pin 34C is configured to slide and pivot within the cam notch 28A, against the bias of the spring 36, to bring the abutment surfaces 38 into engagement with the blocking abutments 30, discussed further below.

During normal operation, (i.e. when disk mass 28 is exposed to an acceleration below a predetermined threshold value via the coupling mechanism 29) little or no relative rotation occurs between nut 39 and disk mass 28 in response to translational movement of leadscrew 26 via cable wire 24. As such, clutch springs 36 are configured to maintain clutch levers 34 in their respective radially inwardly biased unlocked positions, thereby maintaining the abutment surfaces 38 radially inwardly from and out of potential confrontation or engagement with the blocking abutments 30, so as to permit rotation of nut 39 relative to housing 23. Accordingly, during normal operation, the translation component 26 and cable wire 24 fixed thereto are free to translate linearly to move the latch assembly 20 to an unlatched position upon selective actuation of the handle 16, 17, thereby allowing the associated vehicle panel 14 to be opened. In contrast, when a "fast" input motion/"extreme" force accelerates the cable wire 24 above the predetermined acceleration threshold, the corresponding "fast" translational movement/acceleration of the leadscrew 26 through the nut 39 results in a corresponding "fast" angular acceleration of the nut 39, which in turn ultimately results in relative rotation between the nut 39 and the disk mass 28. The relative rotation between the nut 39 and the inertial disk mass 28 occurs due to the resistance provided by the inertia of the inertial disk mass 28 in response to the sudden angular acceleration of the nut 39. As such, the cam pins 34C extending from the clutch levers 34 are caused to slide and pivot in camming relation through the path of the cam notches 28A, which extend, at least in part, radially outwardly to an outer surface/periphery of the disk mass 28. The cam pins 34C sliding through the cam notches 28A generate a force sufficient for the first leg segments 34A to overcome the bias imparted by the clutch springs 36, and thus, the clutch levers 34 are forcibly pivoted about the pivots posts 39C from their radially-inward unlocked position to a radially-extended second or "locked" position such that abutment surfaces 38 extend beyond the outer periphery of the disk segment 39B to confront and mechanically engage corresponding ones of the blocking abutments 30 on the housing section 23A of the housing 23. Accordingly, further rotation of the nut 39 is blocked so as to concurrently/simultaneously inhibit linear movement of the leadscrew 26 and the cable wire 24. Accordingly, the inertial locking device 22 is configured to allow linear travel of the cable wire 24 when the input acceleration to the cable wire 24, and translation component 26 fixed thereto, is below the predetermined acceleration threshold, while at the same time being configured to inhibit and prevent such linear travel of the cable wire 24 and translation component 26 when the acceleration of the cable wire 24 and translation component 26 exceeds the predetermined acceleration threshold value. Upon cessation of the sudden acceleration event in excess of the acceleration threshold, the clutch springs 36 function to automatically reset the clutch levers 34 in their radially inwardly biased, unlocked position to thereafter permit normal operation of the vehicle door latch system.

Figure 10:
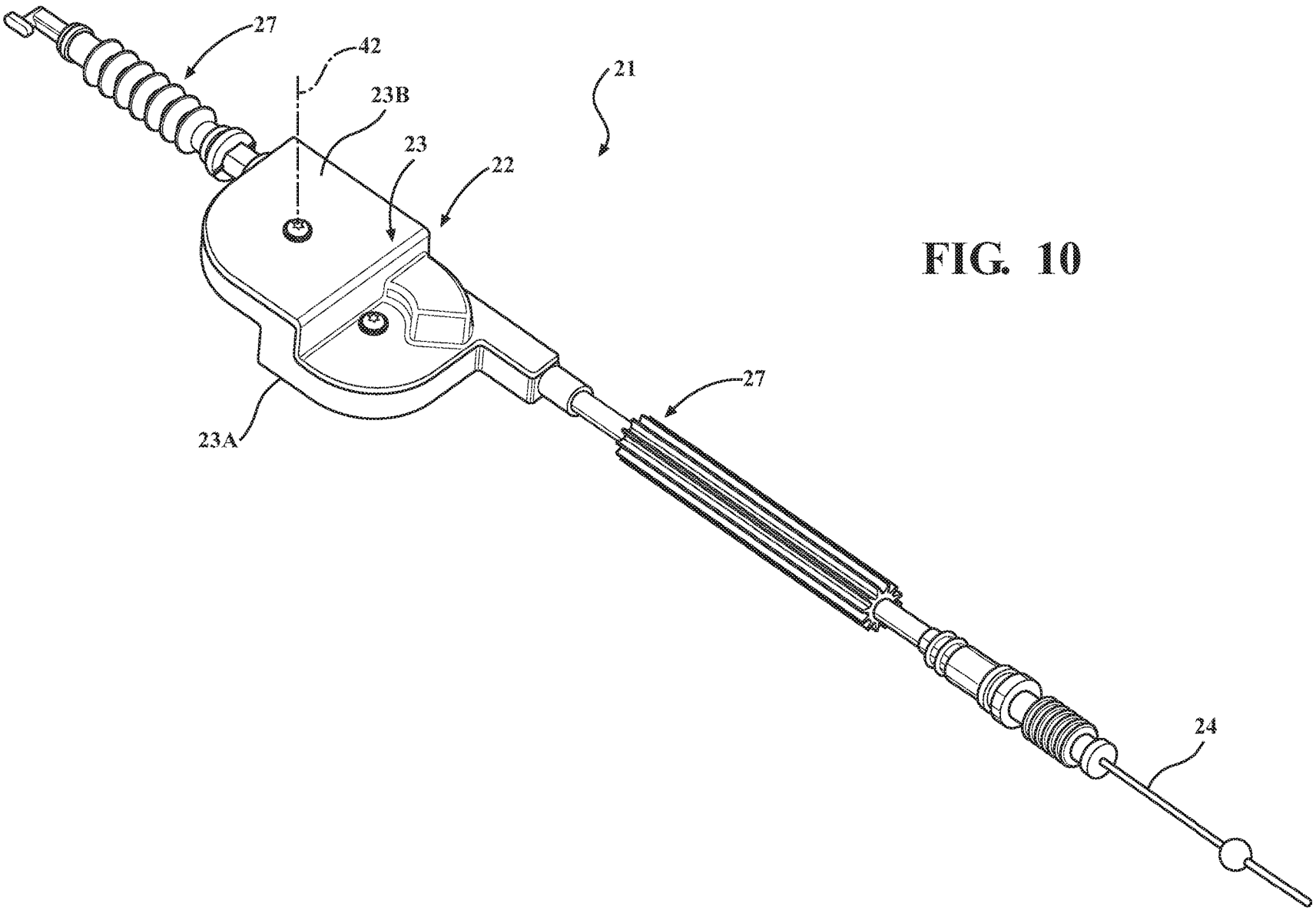
FIG. 10 is a perspective view of a release cable assembly constructed in accordance with a second non-limiting embodiment of the present disclosure.
Figure 11:
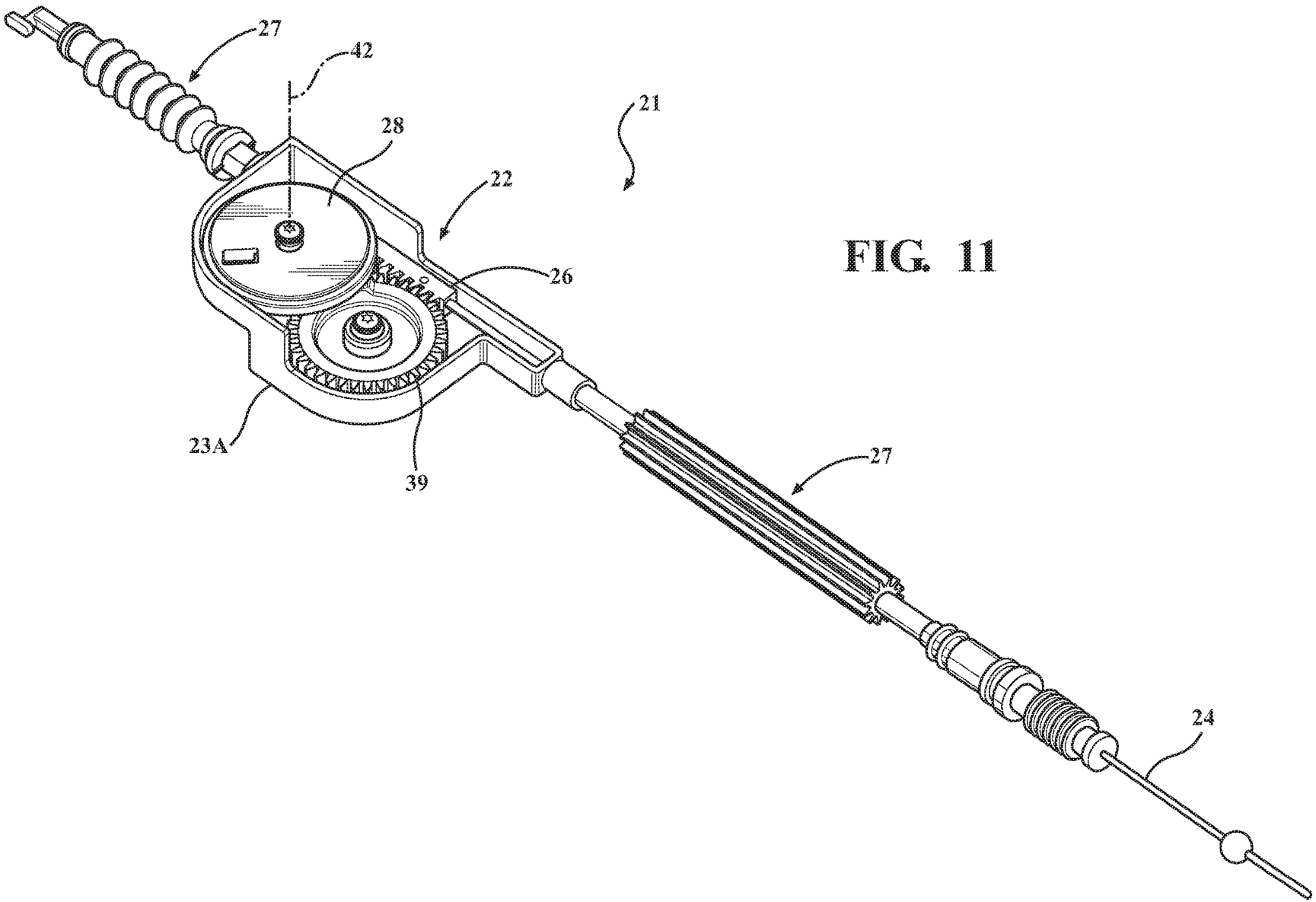
FIG. 11 is a perspective view of the release cable assembly of FIG. 10 with a cover section removed therefrom showing various components of an inertial locking device while in an unlocked position.
Figure 12:
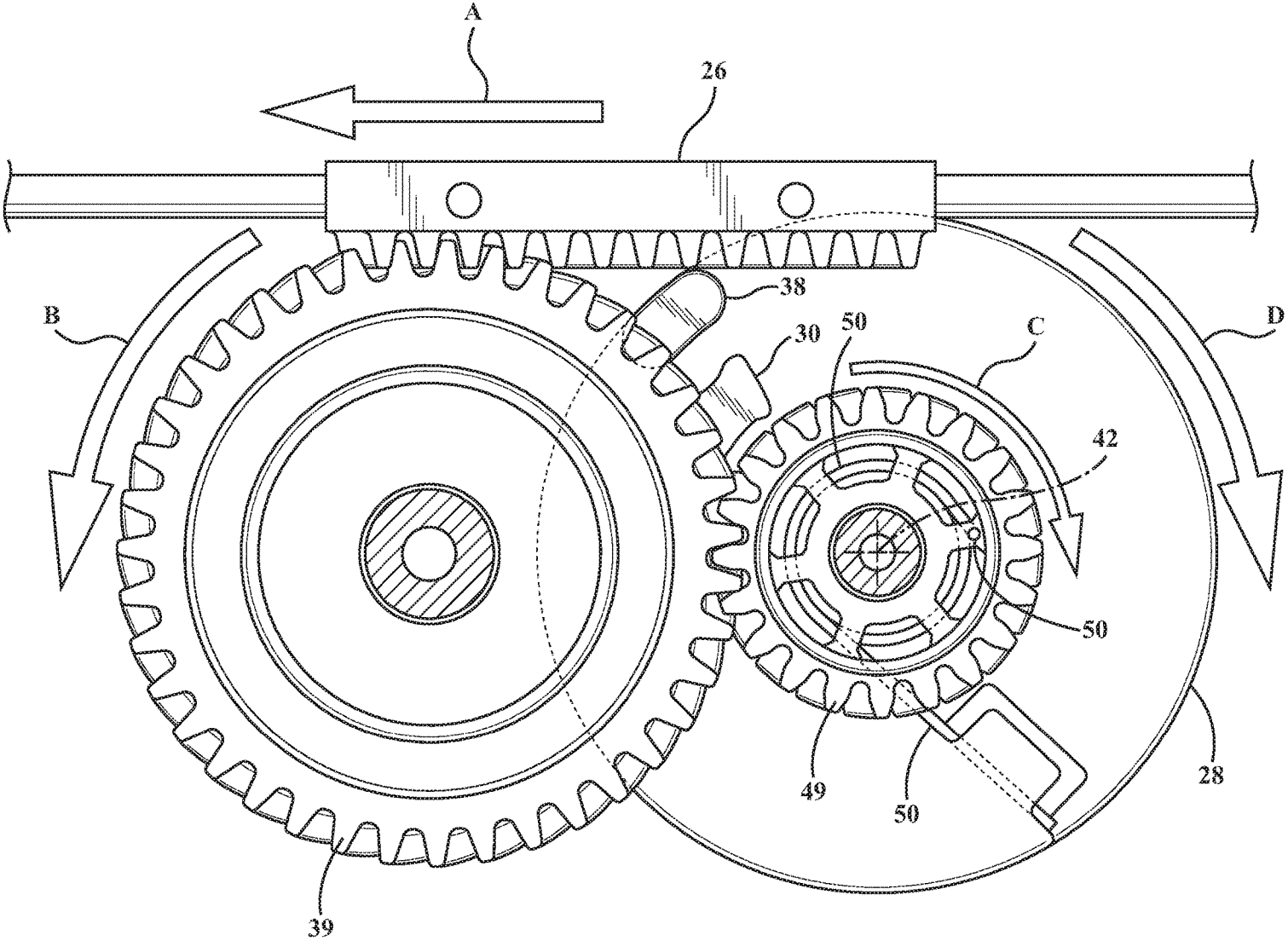
FIG. 12 is a backside view of FIG. 11 with the cover section and a housing section removed therefrom showing various components of the inertial locking device while in an unactuated, unlocked position.

Referring now to FIGS. 10 and 11, a second, non-limiting embodiment of a release cable assembly 21 of the present disclosure having an inertia device 22 connected to release cable 27 is shown. Housing 23 includes a housing section 23A and a cover section 23B that contain inertial mass 28 (e.g. disk mass 28) for rotation about a housing shaft axis 42 coincidentally with a first driven member 39 in the event that translational/linear movement of cable wire 24 is below the specified acceleration threshold. Attached to cable wire 24 is a geared rack 26 (e.g. drive member or translational component 26) which is meshed with the first driven member, represented as a large gear 39 (having a first diameter), that is also rotatably supported on a shaft in housing 23. Large gear 39 is meshed with a second driven member, represented as a pinion gear 49 having a second diameter that is smaller than the first diameter of the large gear 39, forming at least a portion of the coupling mechanism 29. One or more coupling springs 50, forming at least a portion of the coupling mechanism 29, operably couple or interconnect pinion gear 49 for common or conjoint, co-rotation with inertial disk mass 28 below the predetermined acceleration threshold, such as discussed above for the previous embodiment. Disk mass 28 has at least one abutment surface 38 configured to selectively engage at least one blocking abutment 30 formed on and extending radially outwardly from gear teeth of large gear 46.

Figure 13:
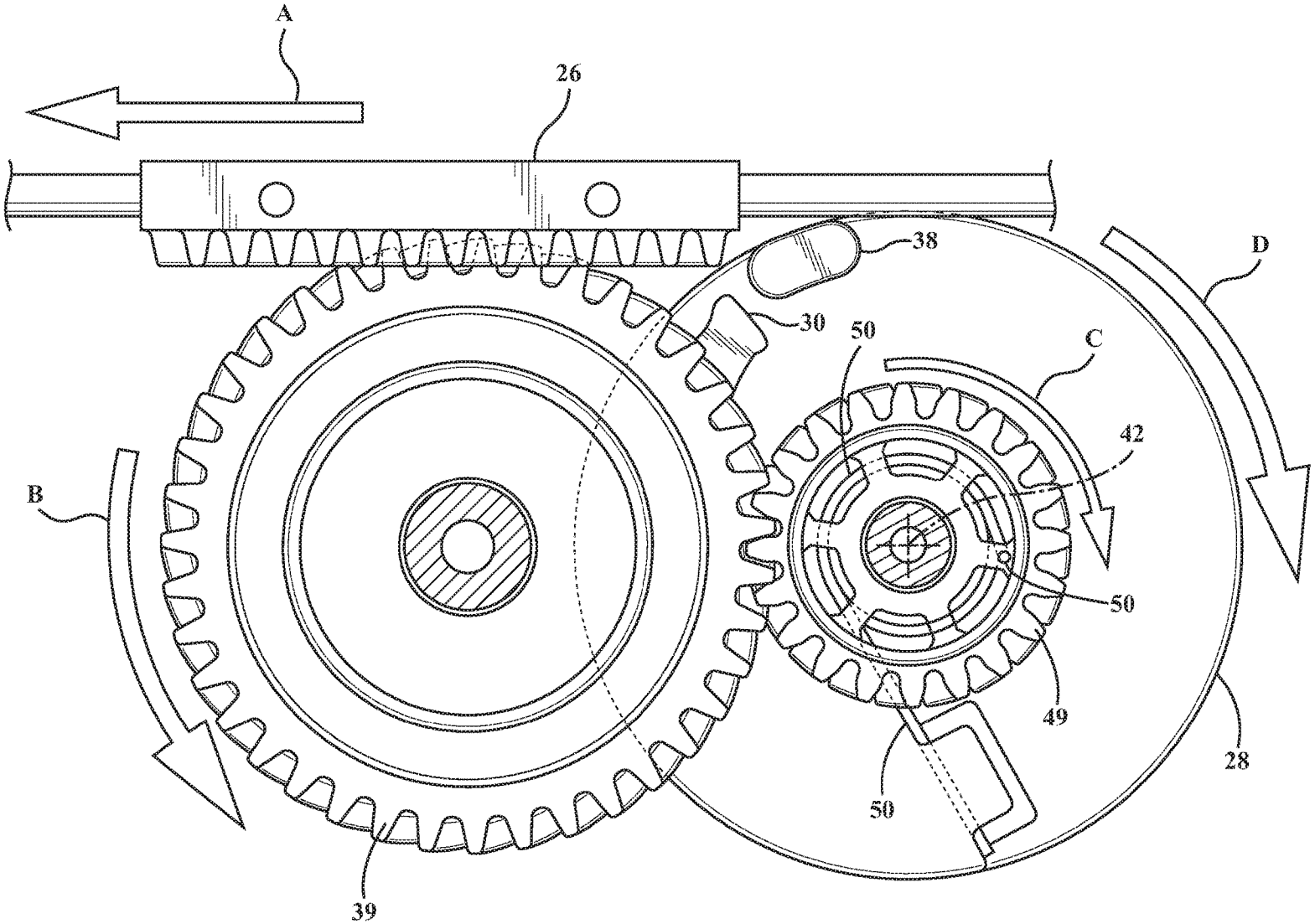
FIG. 13 is a view similar to FIG. 12 showing various components of the inertial locking device while in an actuated, unlocked position.
Figure 20B:
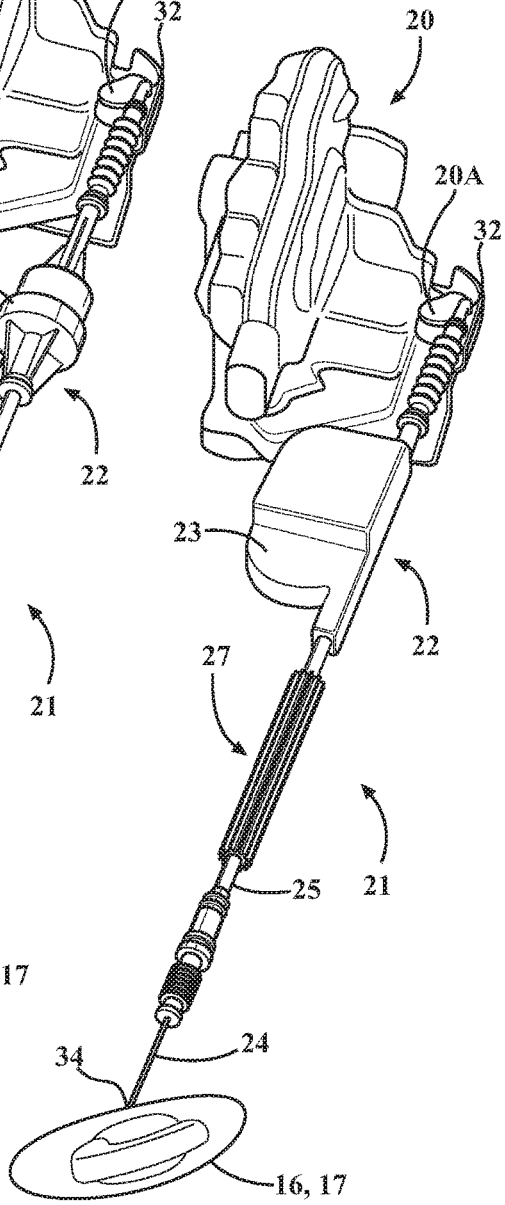

In normal operation, once the translational/linear movement of cable wire 24 is accelerated below the acceleration threshold via actuating the handle 16, 17, as shown in FIG. 20B, the geared rack 26 is pulled linearly with the cable wire 24 to the left (arrow A), which rotates the large gear 39 in a counterclockwise direction (arrow B), which causes the pinion gear 49 to rotate in a clockwise direction (arrow C), thereby driving the disk mass 28, via the bias imparted by coupling spring 50, for co-rotation in a clockwise direction (arrow D) at the same or substantially same rotational speed and acceleration with the pinion gear 48 (for corresponding points having the same radius from axis 42). As such, as shown in FIG. 13, the abutment surface 38 on the disk mass 28 is caused to rotate clockwise along arrow D out of radial alignment and out of the rotational path relative to the blocking abutment 30, which is rotating counterclockwise along arrow B, thereby allowing the abutment surface 38 and the blocking abutment 30 to move away from one another and pass by one another, thus allowing free translation of the cable wire 24 and rack gear 26 and free rotation of the large gear 39. Accordingly, the latch assembly 20 can be readily unlatched, as desired.

Figure 14:
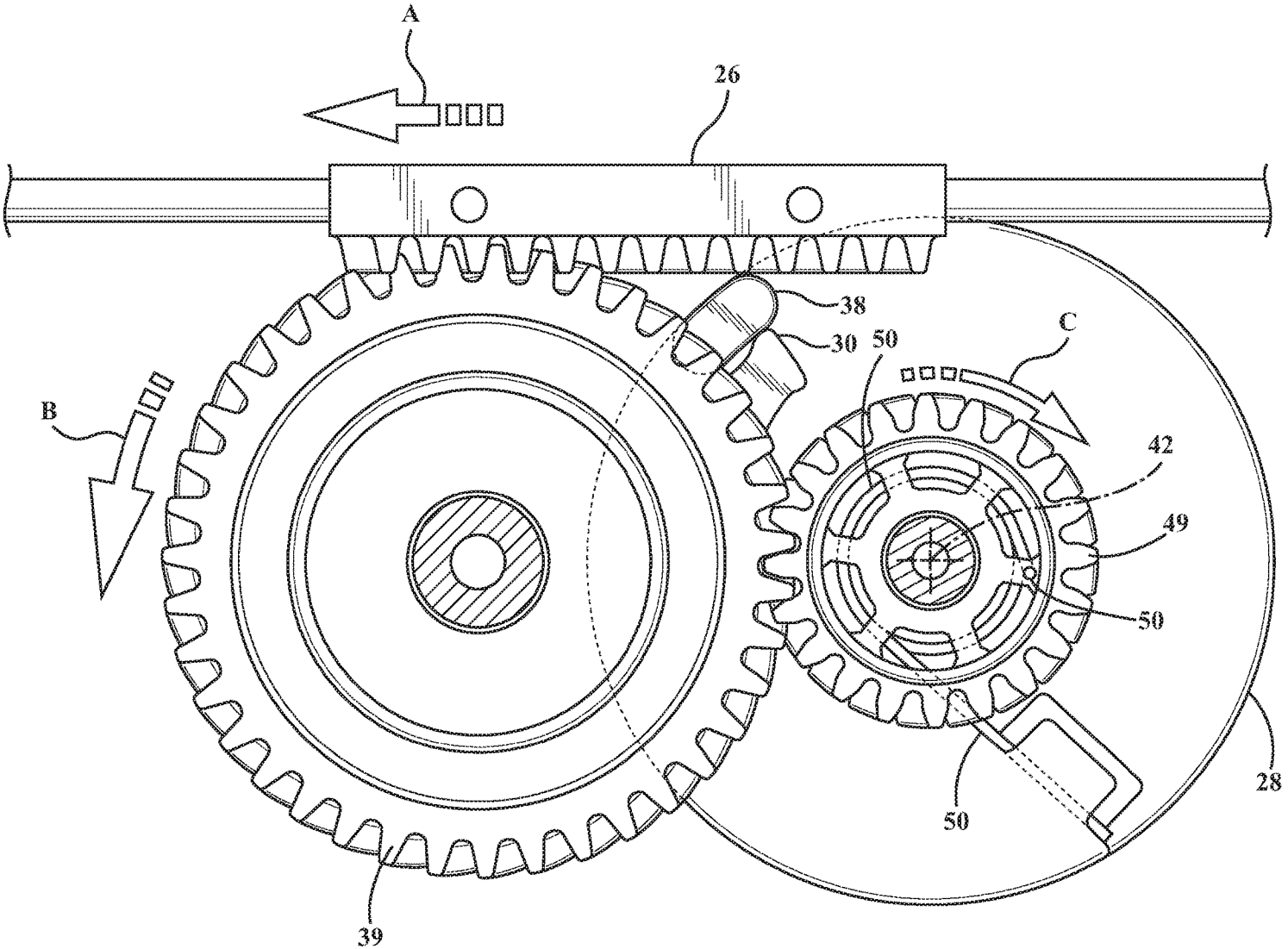
FIG. 14 is a view similar to FIG. 12 showing various components of the inertial locking device while in an actuated, locked position.
Figure 15:
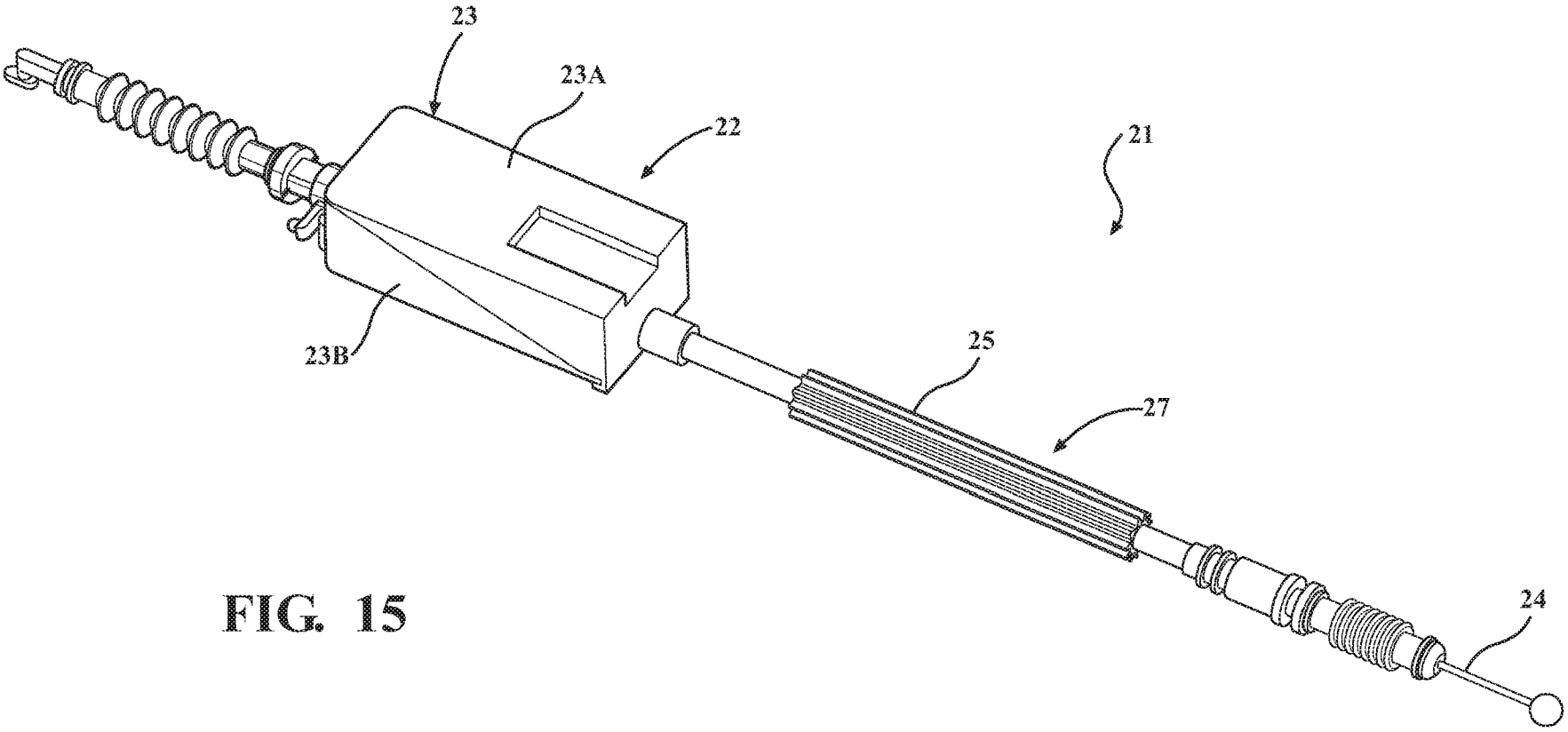
FIG. 15 is a perspective view of a release cable assembly constructed in accordance with a third non-limiting embodiment of the present disclosure.
Figure 16:
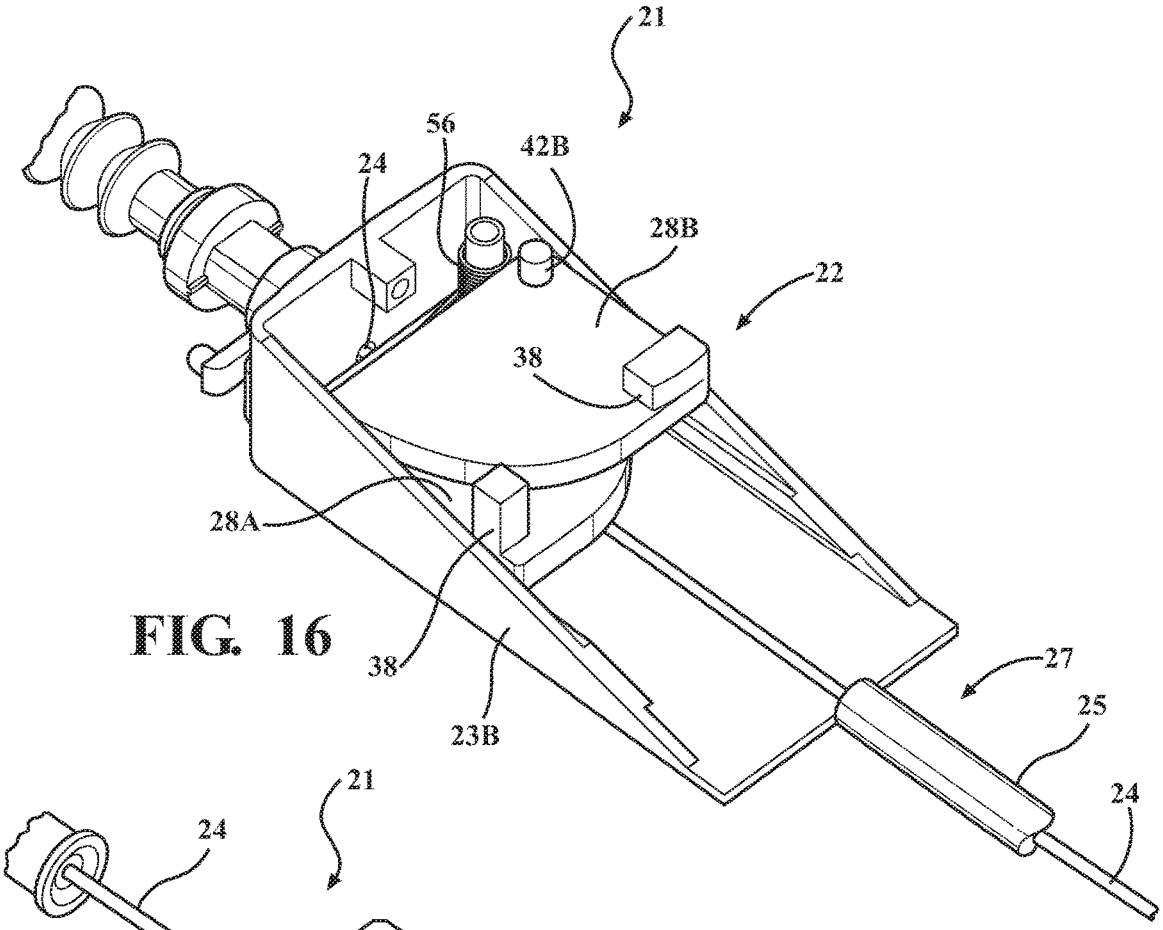
FIG. 16 is a perspective view of the release cable assembly of FIG. 15 with a cover section removed therefrom showing various components of an inertial locking device while in an unactuated, unlocked position.
Figure 17:
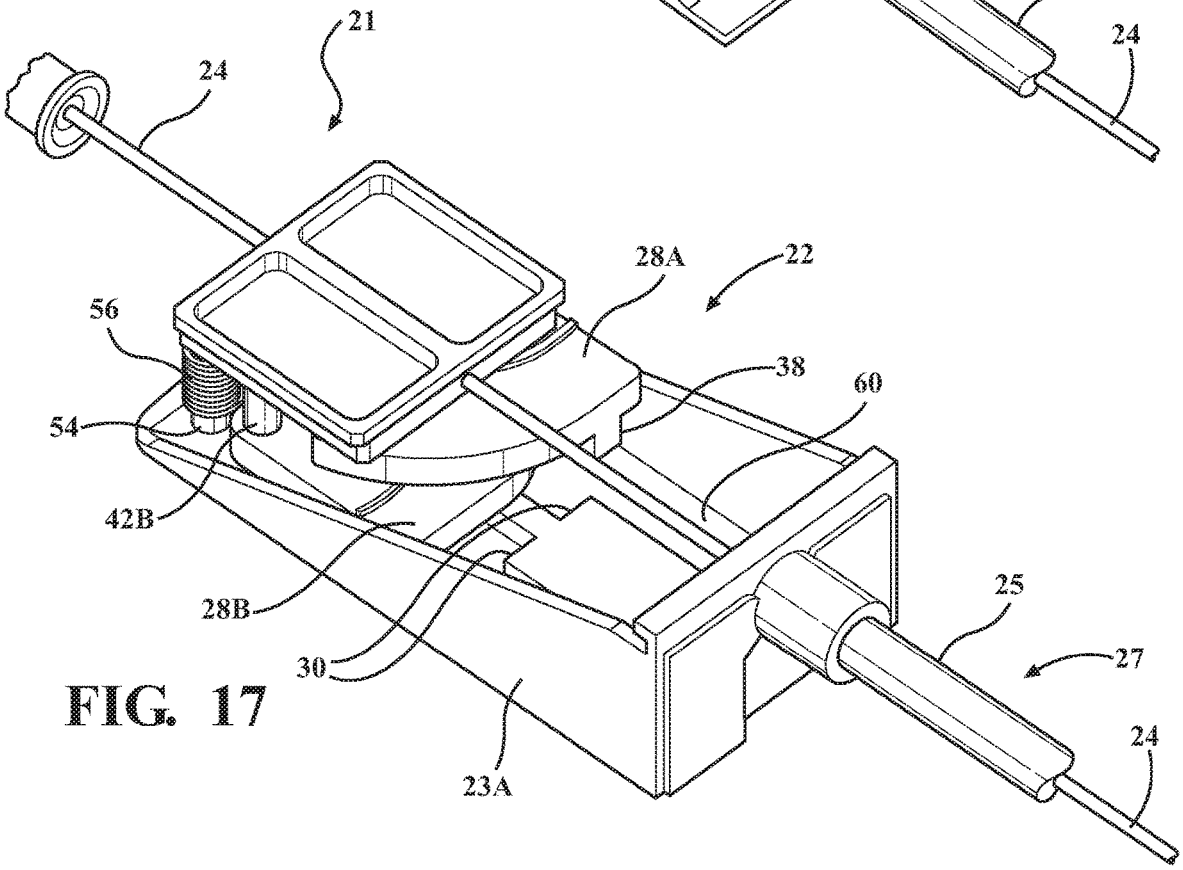
FIG. 17 is a view similar to FIG. 16 with a housing section removed therefrom showing various components of an inertial locking device while in an unactuated, unlocked position.
Figure 18A:
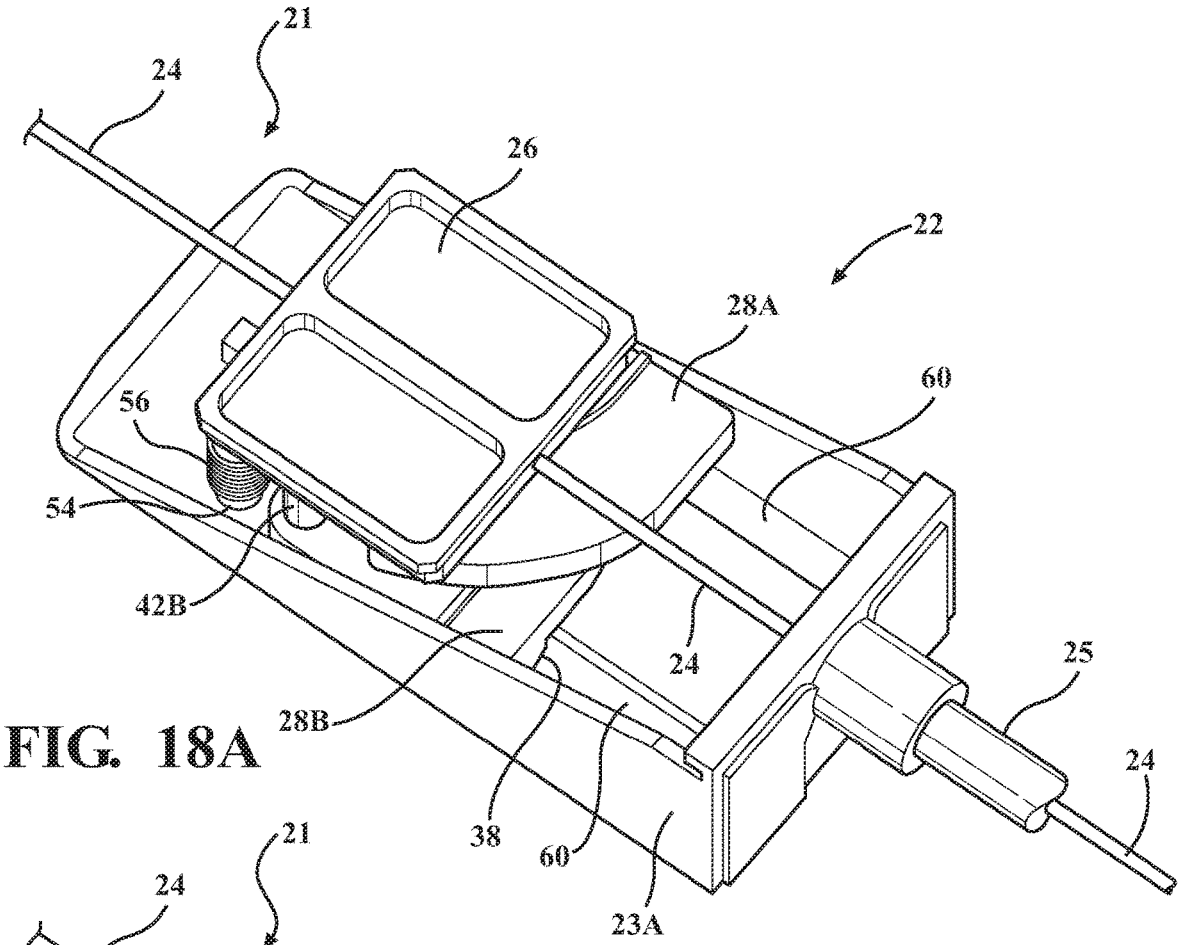
FIG. 18A is a view similar to FIG. 17 showing various components of the inertial locking device while in a partially actuated, unlocked position.
Figure 18B:
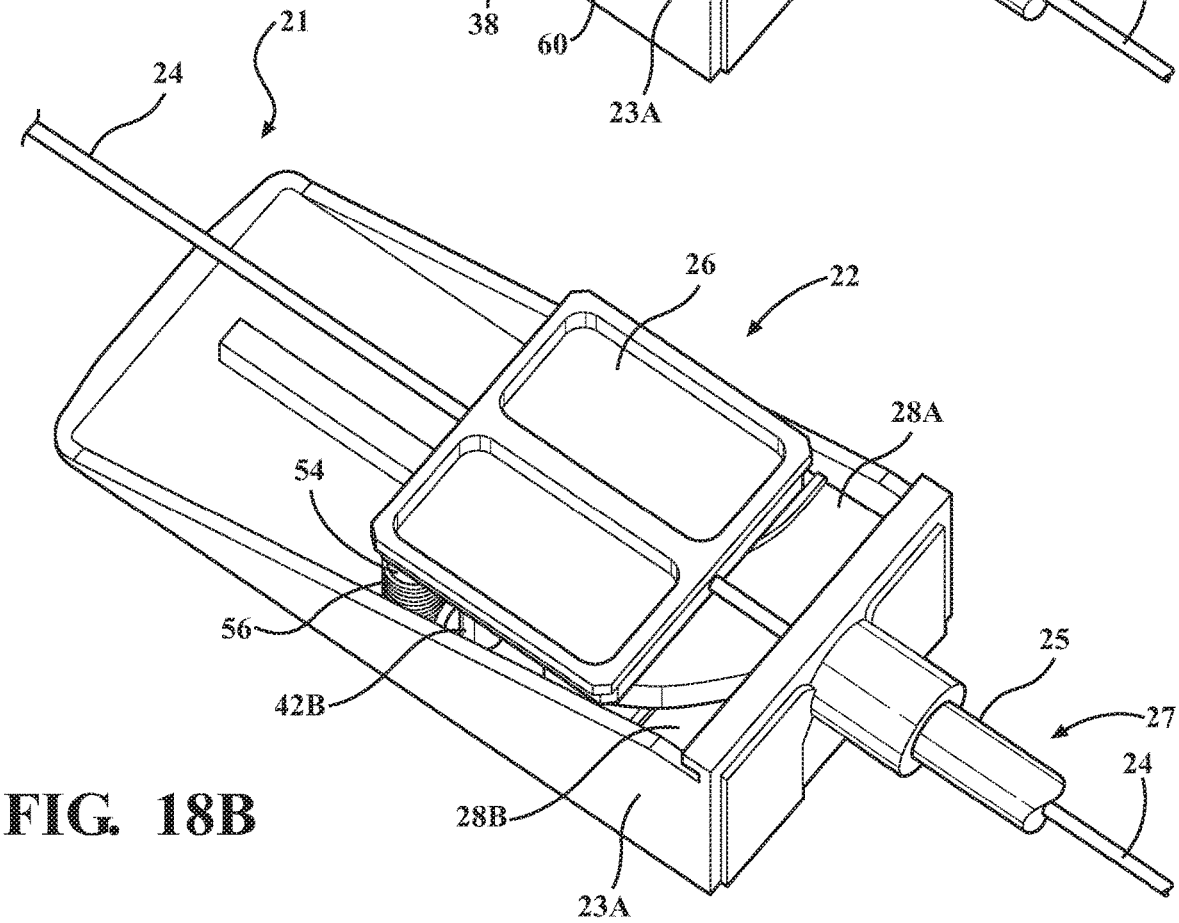
FIG. 18B is a view similar to FIG. 18A showing various components of the inertial locking device while in a fully actuated, unlocked position.
Figure 18C:
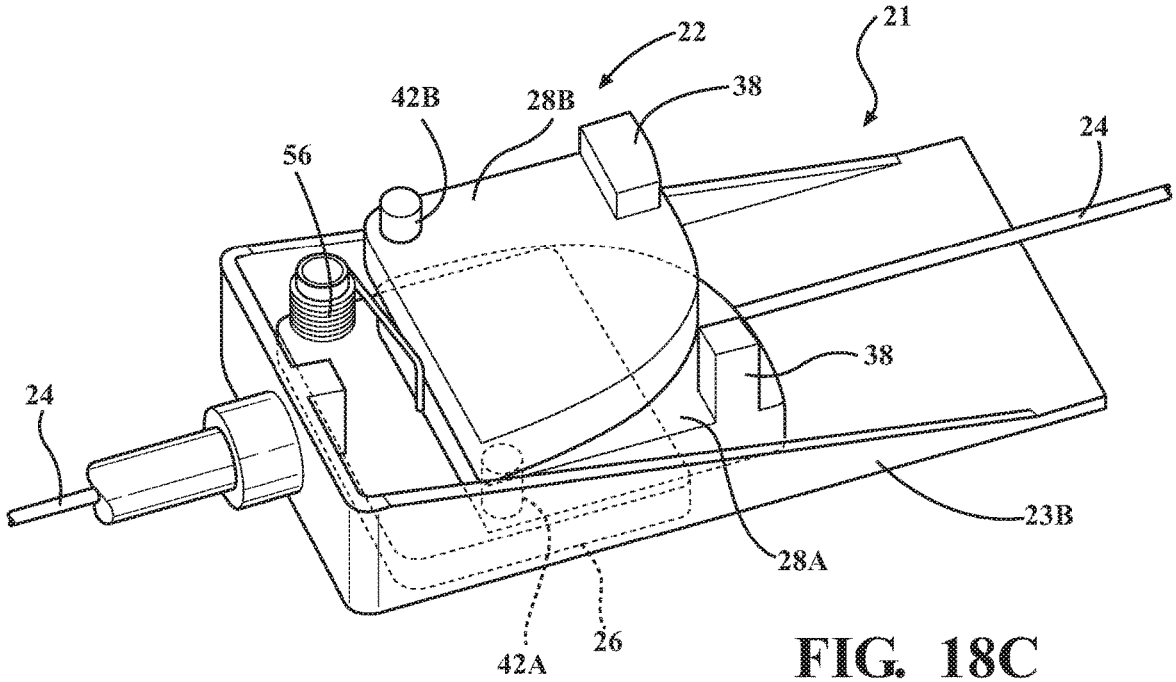
FIG. 18C is a different perspective view showing the various components of the inertial locking device FIG. 18B while in a partially actuated, unlocked position.
Figure 19C:
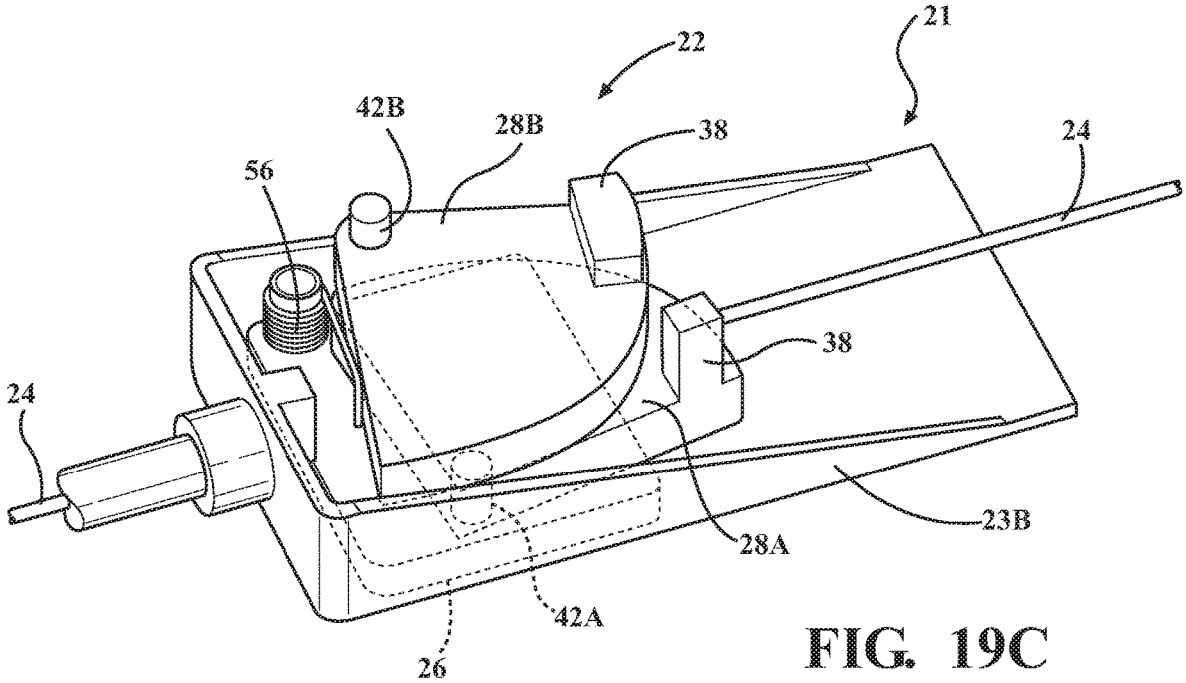
FIG. 19C is a different perspective view showing the various components of the inertial locking device FIG. 19B while in the fully locked position.
Figure 19A:
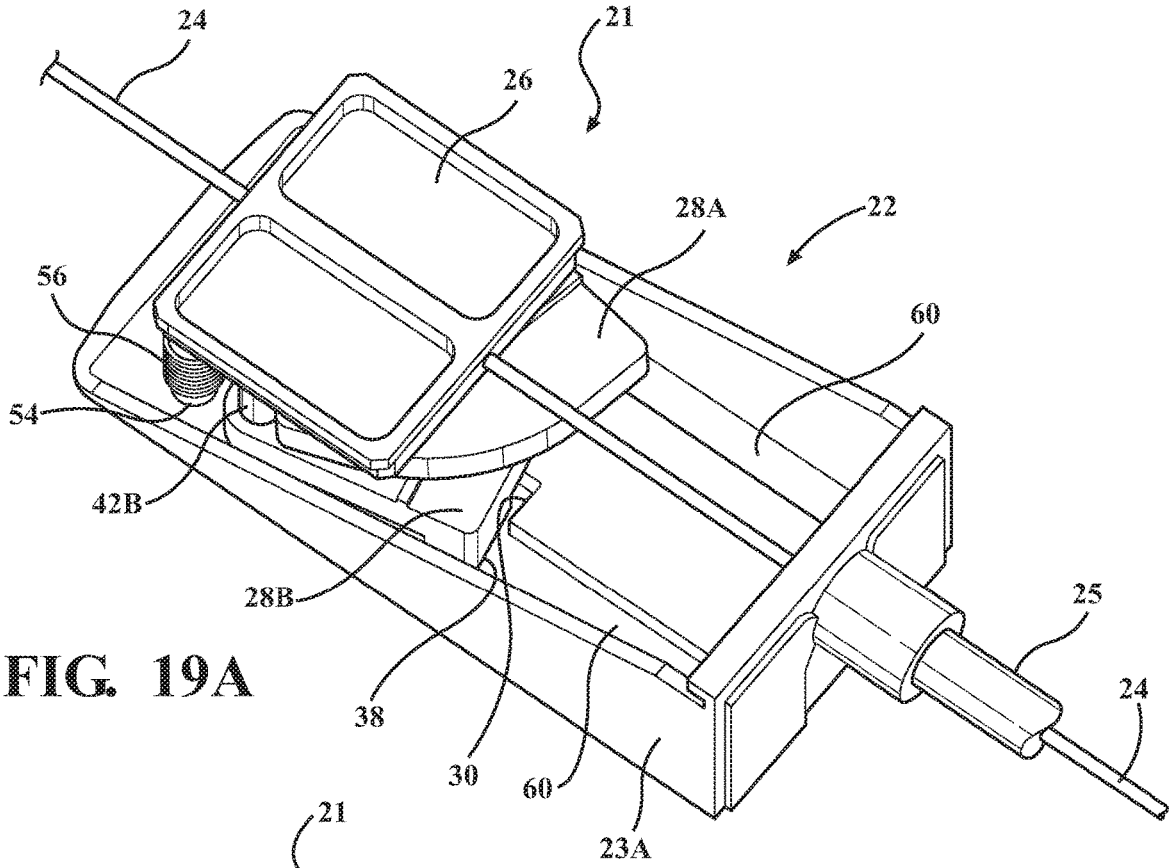
FIG. 19A is a view similar to FIG. 17 showing various components of the inertial locking device while in a partially locked position.
Figure 19B:
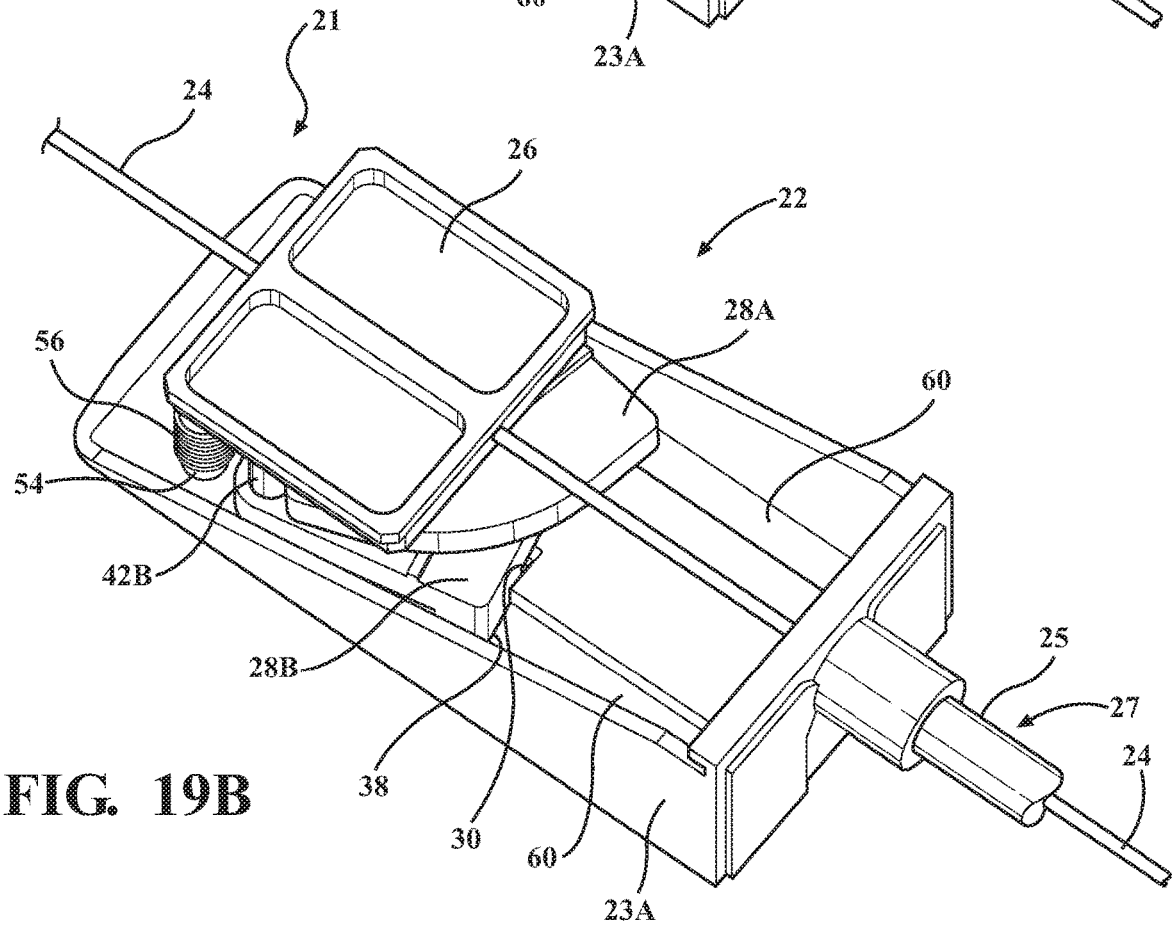
FIG. 19B is a view similar to FIG. 19A showing various components of the inertial locking device while in a fully locked position.

In contrast, in an acceleration condition above the specified acceleration threshold (i.e. "fast" input motion), such as in a crash or otherwise, the relative rotational movement between disk mass 28 and pinion gear 49, caused by the bias of the spring member 50 being overcome by inertia of the inertial disk mass 28, causes blocking abutment feature(s) 38 to remain radially aligned with, and remain in the trajectory path of, the blocking abutment 30 of the large gear 46, thus confronting and blocking any further rotation potential of large gear 46 and inhibiting any further translation/linear movement of rack gear 26 and cable wire 24, thereby preventing the latch assembly 20 from becoming unlatched. As such, the locking device 22 acts to block further cable wire 24 motion within sleeve 26 once blocking abutment feature(s) 38 comes into contact with blocking abutment(s) 30, as shown in FIG. 14. As such, coupling spring 50 couples smaller gear 49 and inertial disk mass 28 to force them to co-rotate as a single unit conjointly with one another below the predetermined acceleration threshold. In contrast, the role of coupling spring 50 is to inhibit or slow rotation of disk mass 28 when translation of cable wire 24 is in an acceleration condition above the specified acceleration threshold by allowing the spring force thereof to be overcome by the resistance force imparted by the inertia of the disk mass 28. As such, similar to the other embodiments herein, the inertia of the disk mass 28 overcomes the spring force of coupling spring 50 in order resist rotation with the pinion gear 49 to inhibit further travel of cable wire 24. FIG. 20B illustrates the second embodiment of release cable assembly 21 (FIG. 10) operably installed between one of handles 16, 17 and door latch assembly 20.

Referring now to FIGS. 15-19, a third, non-limiting embodiment of a release cable assembly 21 is shown having an inertia locking device 22 connected to a release cable 27. Inertia locking device 22 has a housing 23, with a housing section 23A and cover section 23B, containing a pair of first and second inertial masses 28A, 28B respectively configured for pivotal rotation about a pair of pivot members, also referred to as mounting pins 42A, 42B, when the acceleration of cable wire 24 exceeds the specified cable acceleration threshold. Inertial masses 28A, 28B are both pivotably mounted on a drive member, also referred to as translation component or slider component 26, by the coupling mechanism 29 (i.e. mounting pins 42A, 42B extending from the slider component 26 off center from a center of mass of inertial masses 28A, 28B). As such, it is recognized that there are two separate pivot axes (i.e., pivot axes extending through mounting pins 42A, 42B) on opposite sides of slider component 26. Slider component 26 is operably connected to cable wire 24 and thus slider component 26 is configured to translate directly along with translational/linear movement of cable wire 24. Slider component 26 could, for example, be overmolded onto cable wire 24 or alternatively two segments of cable wire 24 could be interconnected to slider component 26. Inertial locking device 22 also has a spring pin 54 extending from slider 26 for mounting of a biasing spring 56, forming at least a portion of the coupling mechanism, between pin 54 and inertial masses 28A, 28B. The role of biasing spring 56 is to inhibit pivotal rotation of disk masses 28A, 28B about pivot axes of mounting pins 42A, 42B when translation of slider 26 is under the specified acceleration threshold. When inertial masses 28A, 28B pivot about the respective pivot axes of mounting pins 42A, 42B under influence of the acceleration of cable wire 24 above the acceleration threshold, abutment surface 38 (i.e., profiled, upstanding peripheral edge surfaces) of inertial masses 28A, 28B are brought into engagement with blocking abutments 30 of housing 23 which are configured as inner housing shoulder surfaces 30.

Figure 20C:
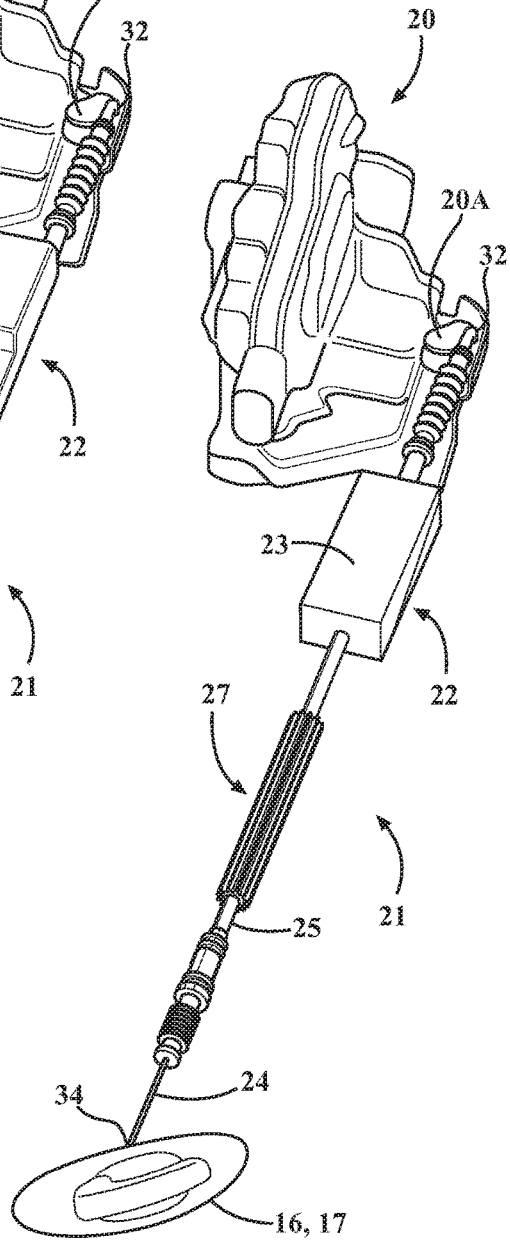

Accordingly, in operation, once the translational/linear movement of cable wire 24 is above the specified acceleration threshold (i.e. "fast" input motion), linear cable wire 24 motion is transferred to (via coupling mechanism 29) to unbalanced inertial masses 28A, 28B. If the acceleration of cable wire 24 (and thus slider 26) is below a certain acceleration threshold ("slow" cable motion), the two inertial masses 28A, 28B do not rotate about pivot axes of the mounting pins 42A, 42B as a result of the bias imparted by the spring 56, and the two inertial masses 28A, 28B just slide linearly along housing 23 within guide regions, such as guides slots 60, shown as being formed in the housing section 23A, by way of example and without limitation, configured to guide translational movement of slider 26 upon being received therein. As soon as cable wire 24 motion is fast enough to generate a sufficient acceleration by surpassing the acceleration threshold, the two inertial masses 28A, 28B pivotally rotate about the pivot axes of the mounting pins 42A, 42B, where their abutment surfaces 38 are pivoted inwardly of the guide slots 60, thereby not entering the guide slots 60, and engage housing blocking abutments 30 (e.g. inner shoulder surface of housing section 23 formed at entrance to guide slots 60). Cable wire 24 is then stopped from further translation/linear motion within sleeve 25 and thus door latch release assembly 20 (FIG. 20C) is inhibited from unlatching. Accordingly, below a certain predetermined acceleration threshold, inertial masses 28A, 28B just translate with slider component 26 without any or significant rotation about the pivot axes of mounting pins 42A, 42B, thereby avoiding engagement of abutment surfaces 38 with abutments 30. However, once the acceleration of slider component 26 reaches or otherwise surpasses the acceleration threshold, inertial masses 28A, 28B rotate about their axes of respective mounting pins 42A, 42B, thus causing engagement of the abutment surfaces 38 of inertial masses 28A, 28B with the blocking abutments 30 of housing 23. FIG. 20C illustrates the third embodiment of the release cable assembly 21 (FIG. 15) operably installed between handles 16, 17 and latch assembly 20.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A release cable assembly, comprising:

a drive member extending along an axis between opposite ends of the drive member;

a cable wire operably connecting a latch assembly of a vehicle panel to a release handle, said cable wire being attached to said drive member to translate said drive member in response to movement of said cable wire along said axis;

at least one inertial mass operably coupled to said drive member via a coupling mechanism and configured for conjoint movement in response to movement of said cable wire and said drive member along said axis;

wherein the coupling mechanism includes at least one spring member imparting a bias to promote said conjoint movement of said inertial mass via said at least one spring exposing said inertial mass to an acceleration in response to movement of said drive member along said axis below an acceleration threshold, inertia of said inertial mass overcoming said bias of said at least one spring member during movement of said drive member along said axis above the acceleration threshold to inhibit movement of said cable wire along said axis, thereby inhibiting movement of a latch release component of the latch assembly from a latched position to an unlatched position.

2. The release cable assembly of claim 1, further including a driven member configured for rotational movement in direct response to linear movement of said drive member along said axis.

3. A release cable assembly, comprising:

a drive member extending along an axis between opposite ends of the drive member;

a cable wire operably connecting a latch assembly of a vehicle panel to a release handle, said cable wire being attached to said drive member to translate said drive member in response to movement of said cable wire along said axis;

at least one inertial mass configured for movement in response to movement of said cable wire and said drive member along said axis;

at least one spring member imparting a bias to promote said movement of said inertial mass in response to movement of said drive member along said axis below an acceleration threshold, inertia of said inertial mass overcoming said bias of said at least one spring member during movement of said drive member along said axis above the acceleration threshold to inhibit movement of said cable wire along said axis, thereby inhibiting movement of a latch release component of the latch assembly from a latched position to an unlatched position;

a driven member configured for rotational movement in direct response to linear movement of said drive member along said axis;

at least one clutch lever pivotally coupled to said driven member, said at least one spring member biasing an abutment surface of said at least one clutch lever radially inwardly to promote co-rotation of said inertial mass with said driven member during movement of said drive member along said axis below the acceleration threshold, said abutment surface of said at least one clutch lever being biased radially outwardly against said bias of said at least one spring member by inertia of said inertial mass to inhibit movement of said cable wire along said axis during movement of said drive member along said axis above the acceleration threshold.

4. The release cable assembly of claim 3, wherein said at least one clutch lever includes a pair of said clutch levers.

5. The release cable assembly of claim 3, further including a housing having at least one blocking abutment, wherein said abutment surface is biased out of engagement from said least one blocking abutment by said at least one spring member during movement of said drive member below the acceleration threshold, and wherein said abutment surface is biased radially outwardly for engagement with said at least one blocking abutment during movement of said drive member above the acceleration threshold.

6. The release cable assembly of claim 5, wherein said housing has a plurality of said blocking abutments spaced circumferentially from one another.

7. The release cable assembly of claim 3, wherein said drive member has an external helical thread and said driven member has a through bore with an internal helical thread, said external and internal helical threads being threadedly coupled with one another.

8. The release cable assembly of claim 3, wherein said driven member has a tubular segment and a disk segment extending radially outwardly from said tubular segment, said at least one clutch lever being pivotally coupled to said disk segment.

9. The release cable assembly of claim 8, wherein said at least one spring member is carried by said disk segment, said at least one spring member having a first end segment engaging said tubular segment and a second end segment engaging said at least one clutch lever.

10. The release cable assembly of claim 9, wherein said inertial mass has an elongated cam slot, said at least one clutch lever having a cam pin disposed in said cam slot, said cam pin being configured for sliding movement in said cam slot during movement of said drive member along said axis above the acceleration threshold.

11. The release cable assembly of claim 10, wherein said disk segment has a pivot post extending outwardly therefrom, said at least one clutch lever having an opening receiving said pivot therein.

12. The release cable assembly of claim 11, wherein said at least one clutch lever has a first leg extending and a second leg extending away from one another on opposite sides of said opening, said second end segment of said at least one spring member engaging said first leg segment, said abutment surface being formed on an end of said second leg segment.

13. The release cable assembly of claim 3, wherein said inertial mass has an elongated cam slot, said at least one clutch member having a cam pin disposed in said cam slot, said cam pin being configured for sliding movement in said cam slot during movement of said drive member along said axis above the acceleration threshold.

14. The release cable assembly of claim 1, further including a first driven member and a second driven member configured in meshed engagement with one another, said first driven member being configured in meshed engagement with said drive member and said second driven member being operably coupled to said at least one inertial mass by said at least one spring member.

15. The release cable assembly of claim 14, wherein said first driven member has a blocking abutment fixed thereto and said at least one inertial mass has an abutment surface fixed thereto, wherein said abutment surface is configured to move out of radial alignment from said blocking abutment during movement of said drive member below the acceleration threshold, and wherein said abutment surface is configured to remain in radial alignment with and confront said blocking abutment during movement of said drive member above the acceleration threshold.

16. The release cable assembly of claim 15, wherein said bias imparted by said at least one spring member causes said at least one inertial mass to co-rotate with said second driven member during movement of said drive member below the acceleration threshold, and wherein said bias of said at least one spring member is overcome by inertia of said at least one inertial mass during movement of said drive member above the acceleration threshold, thereby causing said at least one inertial mass to resist rotating with said second driven member.

17. The release cable assembly of claim 1, wherein said at least one inertial mass includes first and second inertial masses configured for pivotal rotation about a pair of pivot members during movement of said drive member along said axis above the acceleration threshold.

18. The release cable assembly of claim 17, wherein said first and second inertial masses are pivotably mounted on said drive member.

19. The release cable assembly of claim 18, wherein said first and second inertial masses are biased against said pivotal rotation by a bias imparted by said at least one spring member during movement of said drive member along said axis below the acceleration threshold.

20. The release cable assembly of claim 19, wherein said bias imparted by said at least one spring member is overcome by inertia of said first and second inertial masses during movement of said drive member along said axis above the acceleration threshold, thereby causing said first and second inertial masses to pivot about said pair of pivot members to bring abutment surfaces extending from said first and second inertial masses into engagement with blocking abutments and to inhibit movement of said cable wire along said axis.

21. A release cable assembly, comprising:

a drive member extending along an axis between opposite ends of the drive member;

a cable wire operably connecting a latch assembly of a vehicle panel to a release handle, said cable wire being attached to said drive member to translate said drive member in response to movement of said cable wire along said axis;

at least one inertial mass configured for movement in response to movement of said cable wire and said drive member along said axis;

at least one spring member imparting a bias to promote said movement of said inertial mass in response to movement of said drive member along said axis below an acceleration threshold, wherein, during movement of said drive member along said axis above the acceleration threshold, inertia of said inertial mass overcoming said bias of said at least one spring member causing the inertial mass to remain stationary or at a speed less than the drive member to inhibit movement of said cable wire along said axis, thereby inhibiting movement of a latch release component of the latch assembly from a latched position to an unlatched position.

22. The release cable assembly of claim 1, wherein the cable wire is a single cable.

* * * * *